US007752976B2

(12) United States Patent
Banks

(10) Patent No.: US 7,752,976 B2
(45) Date of Patent: Jul. 13, 2010

(54) WARHEAD AND METHOD OF USING SAME

(75) Inventor: Johnny E. Banks, Venus, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 889 days.

(21) Appl. No.: 11/140,131

(22) Filed: May 27, 2005

(65) Prior Publication Data

US 2007/0034073 A1 Feb. 15, 2007

(51) Int. Cl.
*F42B 12/58* (2006.01)
*F42B 12/64* (2006.01)

(52) U.S. Cl. ..... 102/489

(58) Field of Classification Search ..... 102/438, 102/489, 524–528
See application file for complete search history.

(56) References Cited

U.S. PATENT DOCUMENTS 1,734,501 A * 11/1929 Schwoebel ..... 89/1.1
2,818,781 A * 1/1958 Walter ..... 89/40.02
3,427,648 A * 2/1969 Manning et. al. ..... 102/523
3,802,345 A * 4/1974 La Costa ..... 42/78
3,948,175 A * 4/1976 Bucklisch ..... 102/383
4,372,216 A * 2/1983 Pinson et al. ..... 102/489
4,489,638 A * 12/1984 Bastian et al. ..... 89/1.815
4,625,646 A * 12/1986 Pinson ..... 102/489
6,843,179 B2 * 1/2005 Hunn et al. ..... 102/519
2002/0134273 A1 * 9/2002 Mihaylov et al. ..... 102/439
2004/0055502 A1 * 3/2004 Hunn et al. ..... 102/519
2005/0217529 A1 * 10/2005 O'Dwyer ..... 102/526
2007/0074637 A1 * 4/2007 Pontieri ..... 102/501

* cited by examiner

*Primary Examiner*—Troy Chambers
(74) *Attorney, Agent, or Firm*—Davis Patent Services, LLC

(57) ABSTRACT

A warhead includes a barrel operatively associated with the vehicle, the barrel being extendable from and retractable into the vehicle; a penetrator disposed in the barrel; and means for expelling the penetrator from the barrel. A vehicle includes a barrel extendable from and retractable into the vehicle; a penetrator disposed in the barrel; and means for expelling the penetrator from the barrel. A method includes transporting a warhead to a position proximate a target; angularly or translationally positioning a barrel of the warhead; and expelling at least one penetrator from the barrel toward the target. A vehicle includes an airfoil; a barrel operably associated with the airfoil; a penetrator disposed in the barrel; and means for expelling the penetrator from the barrel.

13 Claims, 17 Drawing Sheets

WARHEAD AND METHOD OF USING SAME

BACKGROUND

1. Field of the Invention

The invention relates to a warhead for dispensing one or more penetrators and a method of using the warhead.

2. Description of Related Art

Projectiles, such as rockets, missiles, and the like, find a wide range of very demanding applications. They are frequently employed in many different scenarios with varying degrees of lethality, i.e., the ability of the projectile to disable or destroy its target. These scenarios may range from anti-personnel missions to the delivery of an explosive or a kinetic energy payload to disable, or even destroy, a target. Because of this potential lethality, much consideration is devoted to the design of such projectiles to achieve improved performance. One particular characteristic that is considered is the projectile's "radius of effect", which is the area over which the projectile inflicts damage, expressed generally as the radius of the area.

Some projectiles have a large radius of effect, while others have smaller radii of effect, depending upon the type of target being addressed. Some projectiles, for example, include an explosive warhead that is detonated near or upon contact with an intended target. Such projectiles may have a rather large radius of effect that is commensurate with the explosive warhead blast radius. While effective, such projectiles typically carry a large amount of explosive material, and, therefore, require careful storage and handling. Explosive materials also have a "shelf life." In other words, the explosive materials degrade over time and, depending upon the material, may become less effective and/or more sensitive to inadvertent detonation. Further, explosive warhead projectiles are typically destroyed when their warheads are detonated, so the projectile cannot generally be used to impact the target.

Other projectiles dispense a plurality of grenades or "bomblets" just before the projectile reaches its target. Such projectiles can also have a rather large radius of effect, which corresponds to the area over which the grenades or bomblets are dispersed. The grenades or bomblets are dispensed radially or aftwardly from the projectile. In some embodiments, the projectile rotates about its longitudinal axis (i.e., in the "roll" direction) to produce "centrifugal" force (i.e., an inertial force of rotational motion). The centrifugal force is used to dispense the grenades or bomblets radially from the projectile. In other embodiments, the grenades or bomblets are ejected using a gas or the like aftwardly from the projectile.

In either case, the velocity of the grenades or bomblets relative to the projectile decreases considerably after they are dispensed. The grenades or bomblets include explosive materials that are detonated near or at the target to inflict damage on the target. Thus, such projectiles also suffer from specific shelf lives and generally require careful storage and handling. Further, as in those having explosive warheads, such projectiles are typically destroyed when their warheads are detonated, so the projectile cannot generally be used to impact the target.

Yet other projectiles use their kinetic energy to impact a target, disabling or destroying it by the force of the impact. Such projectiles are often referred to as "hit-to-kill" projectiles. Generally, they employ some sort of dense penetrator that, in concert with its very high velocity, imparts a tremendous amount of kinetic energy on the target. Their radii of effect generally correspond to the radius of the projectile and, thus, are not as large when compared to the projectiles described above. These projectiles, however, are generally lighter weight and have longer ranges than the types discussed above. Further, because they use kinetic energy rather than explosive energy to disable or destroy the target, they are less sensitive to handling and storage and have longer shelf lives.

Certain scenarios and/or targets, however, require a larger radius of effect than can be provided by a conventional kinetic energy projectile. Consider, for instance, a pair of tanks traveling alongside one another. A kinetic energy projectile may be used to disable one of the tanks, but the other may remain viable. "Lethality enhancers" are one type of warhead that has been employed in such situations where a larger radius of effect is desired than can be provided by a kinetic energy or other projectile. Many such conventional warheads comprise fragmentation warheads that, when detonated, send fragments of material into the target. When activated, such warheads inherently destroy portions of the projectile. These warheads, therefore, must be activated very close to the target, so that other portions (e.g., kinetic energy penetrators) of the projectile can inflict damage on the target.

The present invention is directed to overcoming, or at least reducing, the effects of one or more of the problems set forth above.

SUMMARY OF THE INVENTION

In one aspect of the present invention, a warhead for a vehicle is provided. The warhead includes a barrel operatively associated with the vehicle, the barrel being extendable from and retractable into the vehicle; a penetrator disposed in the barrel; and means for expelling the penetrator from the barrel.

In another aspect of the present invention, a vehicle is provided. The vehicle includes a barrel extendable from and retractable into the vehicle; a penetrator disposed in the barrel; and means for expelling the penetrator from the barrel.

In yet another aspect of the present invention, a method is provided. The method includes transporting a warhead to a position proximate a target; angularly or translationally positioning a barrel of the warhead; and expelling at least one penetrator from the barrel toward the target.

In another aspect of the present invention, a vehicle is provided. The vehicle includes an airfoil; a barrel operably associated with the airfoil; a penetrator disposed in the barrel; and means for expelling the penetrator from the barrel.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1A:
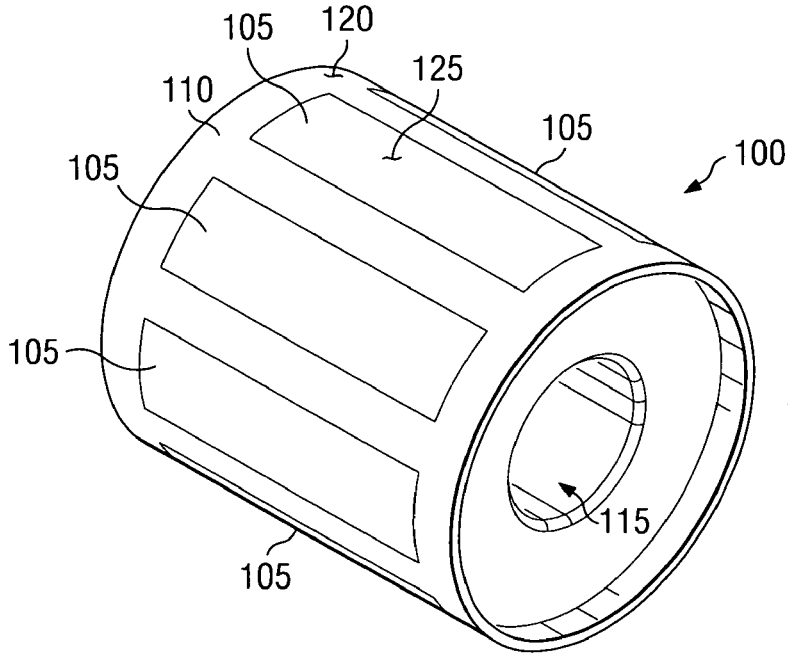
FIG. 1A is a perspective view of an illustrative embodiment of a warhead according to the present invention in its retracted state.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention relates to a warhead that can be incorporated into a vehicle, such as a projectile, a missile, a rocket, a ground-based vehicle, or the like. While the warhead is described herein as being used in a projectile, the scope of the present invention includes its use with any suitable equipment, either stationary or mobile. In one embodiment, the present invention is incorporated into a vehicle, which may traverse the ground, space, or a fluid medium, such as an atmosphere or water. Examples of such vehicles include, but are not limited to, rockets, missiles, projectiles, torpedoes, pods, drones, trucks, tanks, automobiles, and the like. The warhead comprises one or more barrels that are adapted to be extended from and retracted into the projectile. One or more penetrators may be expelled from the barrels in the general direction of the projectile's target. The warhead may be adapted to spin the penetrator, if only one penetrator is expelled, or to spin the plurality of penetrators to disperse the penetrators, if a plurality of penetrators is expelled. Moreover, the vehicle may be adapted to spin to disperse the penetrator or penetrators.

Figure 1B:
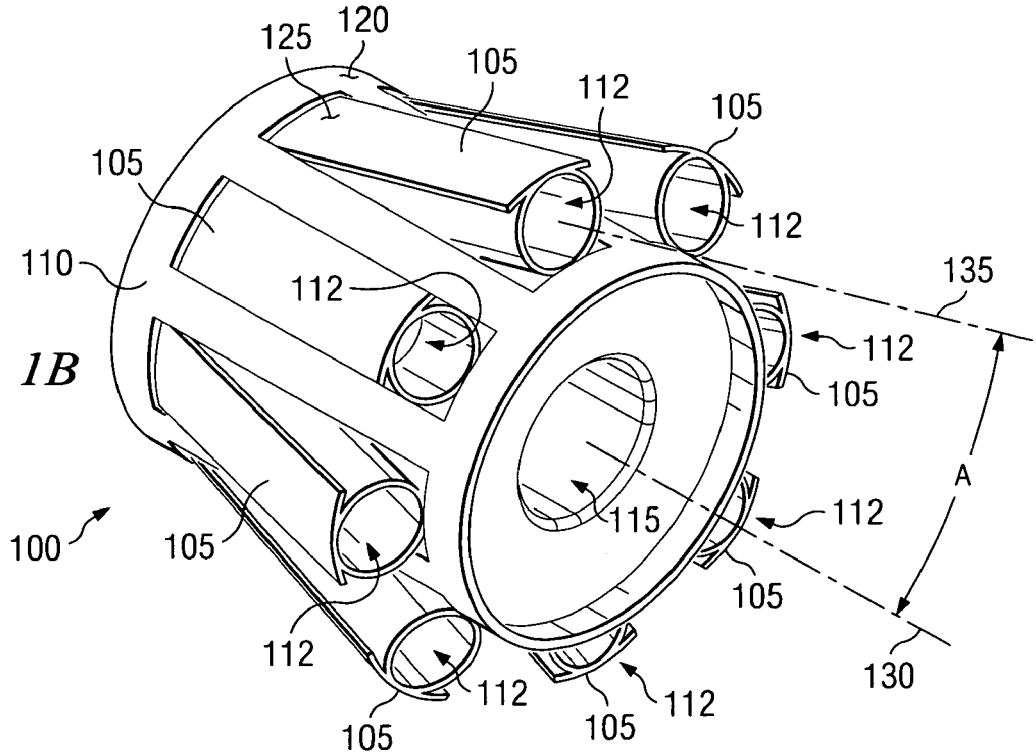
FIG. 1B is a perspective view of the warhead of FIG. 1A in an extended state.

FIG. 1A-FIG. 1B depict a particular illustrative embodiment of a warhead 100 constructed and operated in accordance with the present invention. In the illustrated embodiment, the warhead 100 comprises a plurality of barrels 105 circumferentially disposed about and hingedly attached to a housing 110. Note that the housing 110 may comprise a portion of vehicle's structure, rather than a separate component. The barrels 105 may be independently retracted into the housing 110 (as shown in FIG. 1A) and independently extended from the housing 110 to one or more firing positions (as shown in FIG. 1B). In one particular embodiment, the warhead 100 is constructed such that each of the barrels 105 extends to a fixed, angular firing position. Alternatively, the warhead 100 may be constructed such that each of the barrels may extend to various, predetermined angular firing positions relative to the housing 110. In either case, the barrels 105 extend such that their open ends 112 are facing forward, i.e., toward the target, as will be further discussed below. Note that while the embodiment illustrated in FIG. 1A-FIG. 1B comprises eight barrels 105, the warhead 100 may include any suitable number of barrels 105, including only one barrel 105.

Figure 1C:
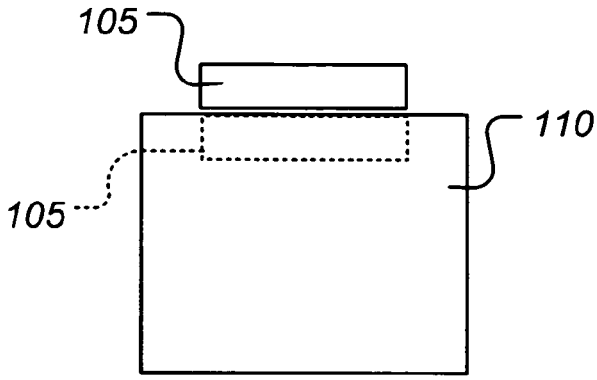
FIG. 1C is a stylized, side, elevational view of an alternative illustrative embodiment of a warhead according to the present invention in which the warhead's barrel is translationally extendable.

Moreover, one or more of the barrels 105 may be translationally extendable to fixed or variable firing positions. For example, as shown in FIG. 1C, the barrel 105 is extended from a stowed position (represented by a dashed line) to a deployed position (represented by a solid line). The scope of the present invention encompasses barrels 105 that can be both angularly and translationally extended.

Figure 2:
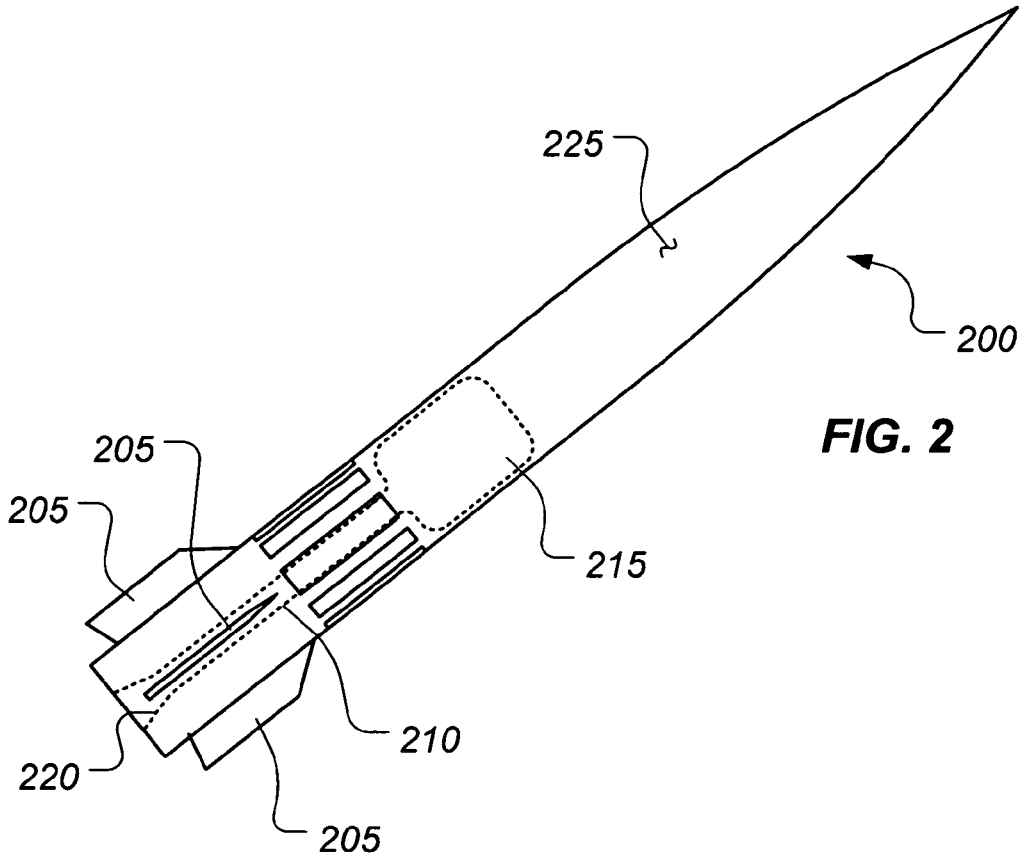
FIG. 2 is a side view of an illustrative embodiment of a projectile incorporating the warhead of FIG. 1A-FIG. 1B according to the present invention.

FIG. 2 depicts one particular illustrative embodiment of a projectile 200 comprising the warhead 100, shown with its barrels 105 retracted. In the illustrated embodiment, the warhead 100 is disposed just forward of the projectile 200's fins 205. The scope of the present invention, however, is not so limited. Rather, the warhead 100 may be disposed at other locations along the length of the projectile 100. Further, the projectile 200 may comprise more than one warhead 100.

The particular projectile 200 illustrated in FIG. 2 comprises a "blast tube" 210 extending between a rocket motor 215 and an exhaust cone 220. In the embodiment illustrated in FIG. 1A-FIG. 1B, the warhead 100's housing 110 is constructed to define a central opening 115, such that the blast tube 210 may extend therethrough. Note that the particular construction of the housing 100 will be implementation specific. Thus, in other embodiments, the housing 100 may not include the central opening 115 but may include other features particular to the implementation depending in part upon the location of the warhead 100 in the projectile 200.

In various constructions of the present invention, an outer surface 120 of the housing 110 may define a portion of an outer surface 225 of the projectile 200. In such embodiments, outer surfaces 125 of the barrels 105 are generally flush with the outer surface 120 of the housing 110 when the barrels 105 are in their retracted position (as shown in FIG. 1A). Alternatively, the housing 110 may be disposed within the projectile 200, such that an outer skin of the projectile 200 extends over the housing 110 but not over the barrels 105. In this embodiment, the outer surfaces 125 of the barrels 105 are generally flush with the outer surface 225 of the projectile 200 when the barrels 105 are in the retracted position (as shown in FIG. 1A).

Figure 3A:
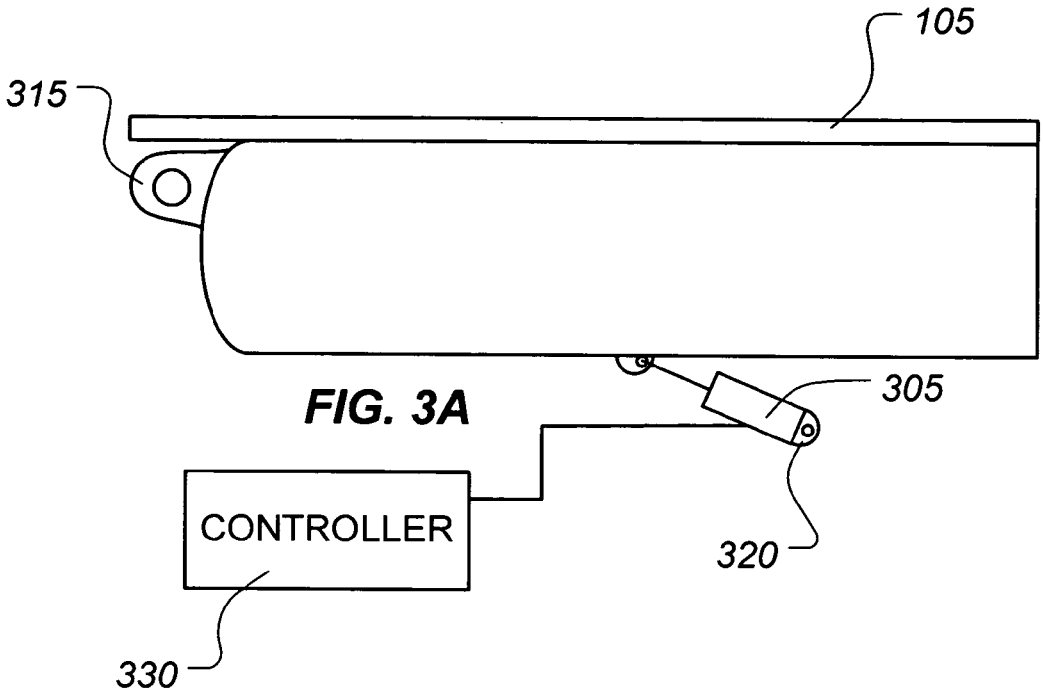
FIG. 3A is a stylized, side view of an illustrative embodiment of a barrel in its retracted state, an actuator, and a controller of the warhead of FIG. 1A-FIG. 1B according to the present invention.
Figure 3B:
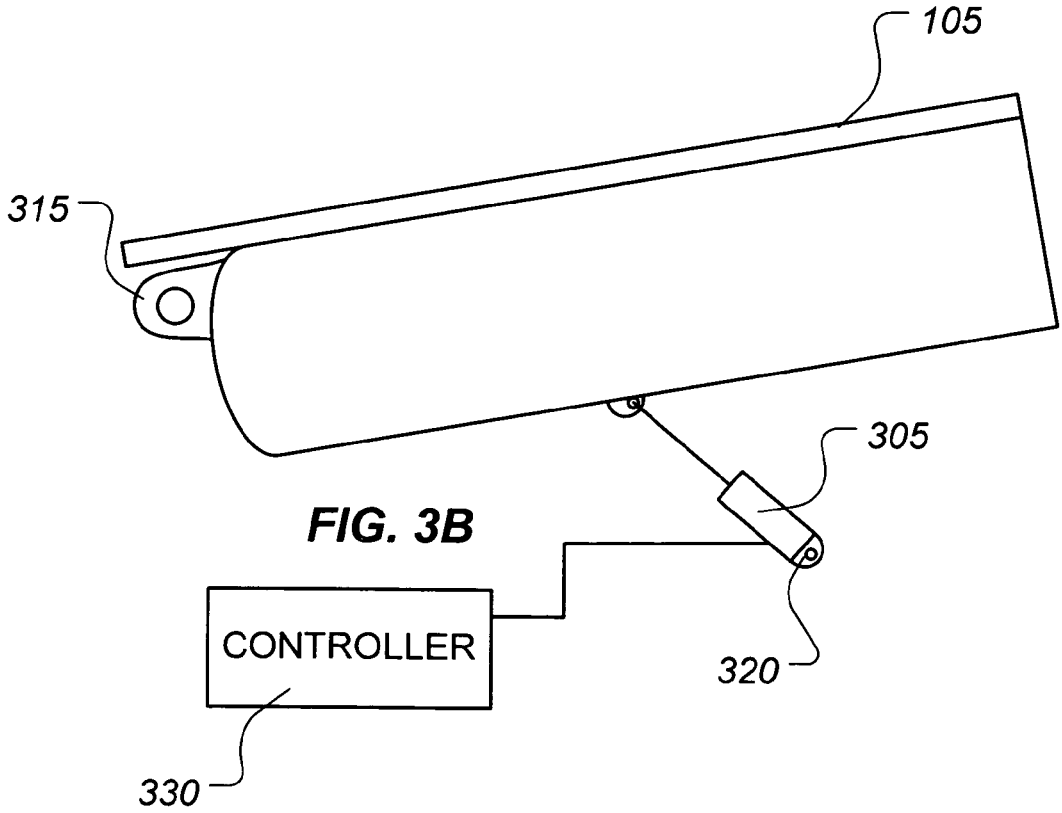
FIG. 3B is a stylized, side view of the barrel, the actuator, and the controller of FIG. 3A with the barrel in an extended state.

While the barrels 105 may be extended from the housing 110 by various means, FIG. 3A-FIG. 3B depict one particular illustrative embodiment wherein a linear actuator 305 is used for this purpose. FIG. 3A illustrates the barrel 105 in its retracted position, while FIG. 3B illustrates the barrel in an extended position. In the illustrated embodiment, the barrel 105 is hingedly attached to the housing 110 via a hinge 315 and the linear actuator 305 is hingedly attached to the housing 110 via a hinge 320. The linear actuator 305 also is hingedly attached to the barrel 105 in the same fashion.

Commands, which may take the form of electrical signals, are transmitted by a controller 330 to drive the actuator 305. Depending upon the particular implementation, the controller 330 and the actuator 305 may, in concert, fully extend or fully retract the barrel 105 or they may extend or retract the barrel 105 in various degrees with respect to the housing 110. Note that the linear actuator 305 may comprise many such actuators as are known to the art. The controller 330 may comprise at least a portion of a complex fire control system or may merely comprise, for example, a switch that directs the actuator 305 to extend the barrel 105. Further, the representation of the actuator 305 in FIG. 3A-FIG. 3B is merely schematic in nature and may or may not reflect the actual construction of the actuator 305.

Figure 4:
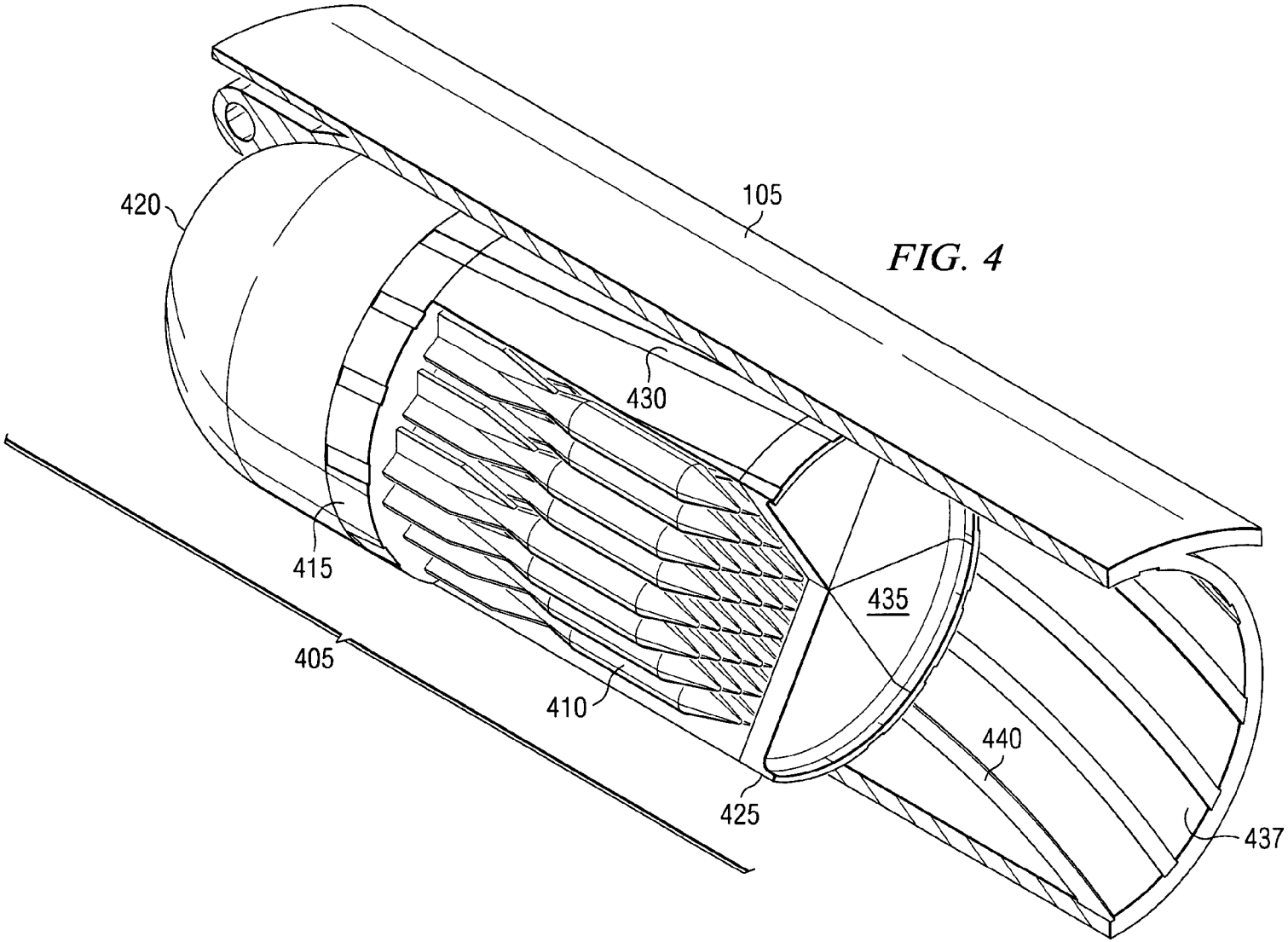
FIG. 4 is a partial cross-sectional, perspective view of one particular illustrative embodiment of the barrel and a cartridge of the warhead of FIG. 1A-FIG. 1B.
Figure 5A:
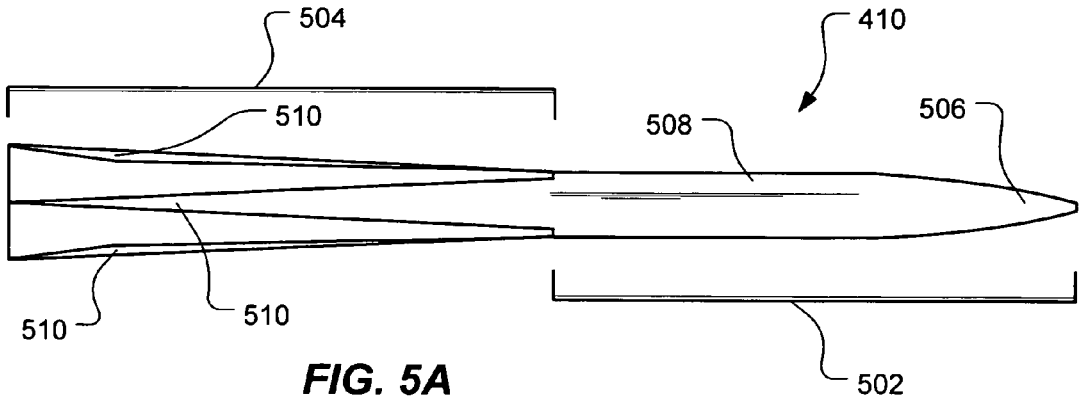
FIG. 5A is a side view of a first illustrative embodiment of a penetrator of the warhead of FIG. 1A-FIG. 1B according to the present invention.

The barrels 105 are adapted to hold one or more penetrators that, at a desired point in time, are expelled or fired therefrom toward a target. FIG. 4-FIG. 6 show one particular illustrative embodiment of a cartridge 405 including a plurality of penetrators 410 (only one indicated for clarity and best shown in FIG. 8). In addition to the plurality of penetrators 410, the cartridge 405 of the illustrated embodiment comprises a pusher plate 415 disposed between an expulsive charge 420 and the plurality of penetrators 410. The expulsive charge 405, in various illustrative embodiments, may comprise a compressed gas canister, a gas generator, or an explosive, such as rifle, pistol, or shotgun powder.

The plurality of penetrators 410 is disposed within a dunnage or sabot 425 that, in the illustrated embodiment, abuts the pusher plate 415 and otherwise surrounds the penetrators 410. In various embodiments, the sabot 425 may comprise aluminum (or an alloy thereof) or a polymeric material. In one embodiment, the sabot 425 (best shown in FIG. 9) and an interior surface 435 of the barrel 105 define rifling grooves 430, 440, respectively, which interact to impart a spin on the sabot 425 (and thus the penetrators 410) as it leaves the barrel 105, as will be discussed in more detail below.

The penetrators 410 may comprise numerous constructions in various embodiments. Generally, the penetrators 410 are constructed such that they are aerodynamically stable when expelled from the barrel 105, such that they will travel toward the projectile 200's target in an aerodynamically stable fashion at a velocity greater than that of the projectile 200. While the penetrators 410 may take on many different forms, various particular embodiments of the penetrator 410 are shown in FIG. 5A-FIG. 7. In the embodiment illustrated in FIG. 5A, the penetrator 410 includes a forebody 502 and an aerodynamically stabilizing portion 504, sometimes referred to as a "tail". In one embodiment, at least part of the stabilizing portion 504 is adapted to produce a plurality of sparks as a result of an impact with a target (not shown in FIG. 5A) for igniting the target, material proximate the target, and/or material contained by the target. In another embodiment, the forebody 502 comprises tungsten or a tungsten alloy and the stabilizing portion 504 comprises aluminum or an aluminum alloy.

In the illustrated embodiment, the forebody 502 comprises a nose 506 shaped to lessen the effects of aerodynamic drag on the penetrator 410 and to enhance the penetrating capability of the penetrator 410. Moving aftward along the forebody 502, the nose portion 506 transitions to a body portion 508, which transitions to the stabilizing portion 504. The stabilizing portion 504 provides aerodynamic stability to the penetrator 410 and, in one embodiment, comprises a plurality of outwardly extending fins 510 for that purpose. Further, in the illustrated embodiment, the stabilizing portion 504 slopes radially outwardly in an aftward direction (i.e., away from the nose 506). While the stabilizing portion 504 illustrated in FIG. 5A comprises three fins 510, the present invention is not so limited. Rather, the scope of the present invention encompasses a stabilizing portion (e.g., the stabilizing portion 504) having any chosen number of fins 510, such as four fins 510.

Figure 5B:
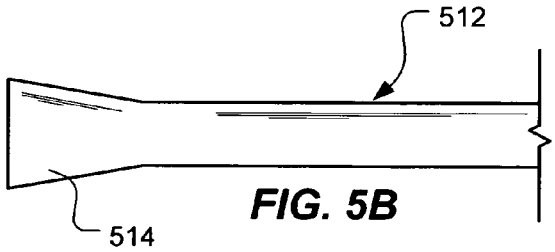
FIG. 5B-FIG. 5C are partial side views of the penetrator of FIG. 5A depicting alternative stabilization members.
Figure 5C:
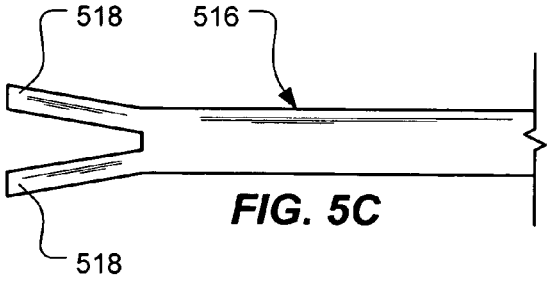

It may be desirable in certain applications for the penetrator 410 to include a stabilizing portion having a configuration that is different from the stabilizing portion 504. For example, as shown in FIG. 5B, the penetrator 410 may include a stabilizing portion 512 comprising a flare 514 that slopes radially outwardly in an aftward direction (i.e., away from the nose 506) for aerodynamically stabilizing the penetrator 410. Alternatively, as depicted in FIG. 5C, the penetrator 410 may include a stabilizing portion 516 comprising a plurality of radially outwardly and aftwardly extending flaps 518 for aerodynamically stabilizing the penetrator 410. The present invention, however, is not limited to the stabilizing portions 504, 512, 516 as disclosed herein. Rather, the scope of the present invention includes any chosen flight control surface for stabilizing the penetrator 410 and, in some embodiments, at least a portion thereof is adapted to produce a plurality of sparks upon impact with a target.

As discussed above, the stabilizing portions 504, 512, 516 in some embodiments are adapted to produce a plurality of sparks as a result of an impact with a target for igniting the target, material proximate the target, and/or material contained by the target. The stabilizing portions 504, 512, 516 may implement this capability in various ways. For example, the entire stabilizing portion 504, 512, 516 may comprise a "pyrophoric" material. As used herein, the term "pyrophoric material" means a material capable of emitting sparks and/or self-igniting when scratched or struck. Such materials generally do not need the careful handling and storage typically required for explosive and/or incendiary materials and typically do not significantly degrade over time. Alternatively, a part of the stabilizing portion 504, 512, 516, such as one or more of the fins 510, the flare 514 or a portion thereof, or one or more of the flaps 518, may comprise a pyrophoric material. Thus, by way of example and illustration, the stabilizing portion 504, 512, 516 or a portion thereof comprising a pyrophoric material is but one means for producing a plurality of sparks as a result of an impact with a target.

In one embodiment, the pyrophoric material comprises mischmetal, which, in one form, comprises about 50 percent cerium, about 25 percent lanthanum, about 18 percent neodymium, about five percent praseodymium, and about two percent other rare earth metals. In another embodiment, the pyrophoric material comprises a mischmetal mixture, for example, a mixture comprising about 30 percent iron and about 50 percent mischmetal. In yet another embodiment, the pyrophoric material comprises at least one of zirconium, a zirconium alloy, and a depleted uranium alloy. The present invention, however, is not limited to the pyrophoric materials discussed above. Rather, the scope of the present invention encompasses at least a part of the stabilizing portion 504, 512, 516 comprising any chosen pyrophoric material in those embodiments wherein the stabilizing portion 504, 512, 516 is adapted to produce a plurality of sparks upon impact with a target.

Figure 6A:
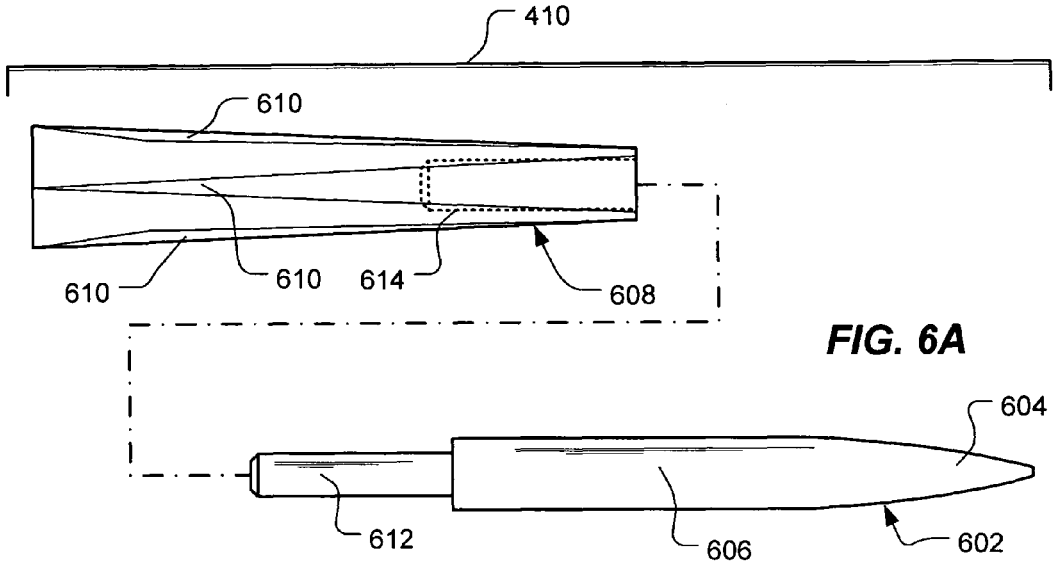
FIG. 6A is an exploded, side view of a second illustrative embodiment of a penetrator of the warhead of FIG. 1A-FIG. 1B according to the present invention.

It may be desirable in certain applications for the forebody 502 and the stabilizing portion 504, 512, 516 (shown in FIGS. 5A-5C) to comprise separate components. Accordingly, FIG. 6A depicts a side, elevational, exploded view of a second illustrative embodiment of the penetrator 410 according to the present invention. The penetrator 410 comprises a forebody 602 including a nose 604 and a body portion 606 that are, in the illustrated embodiment, similar to the nose 106 and the body portion 108, respectively, of the first embodiment (shown in FIG. 5A). The penetrator 410 further comprises a stabilizing portion 608 comprising a plurality of fins 610 that, in the illustrated embodiment, are similar to the fins 110 of the first embodiment (shown in FIG. 5A).

Figure 6B:
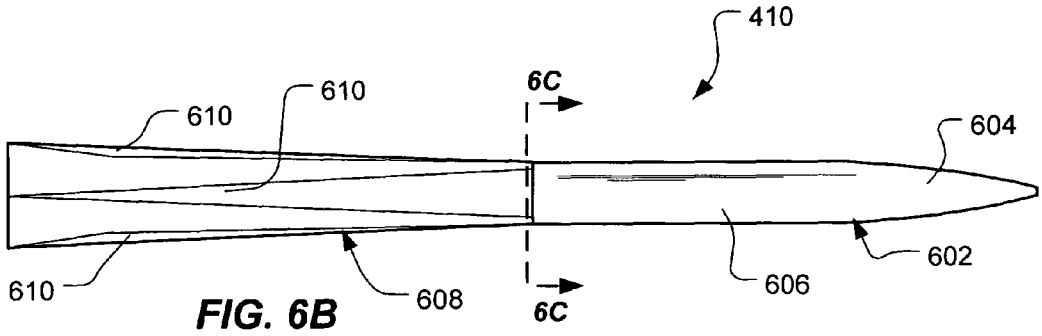
FIG. 6B is an assembled, side view of the penetrator of FIG. 6A.
Figure 6C:
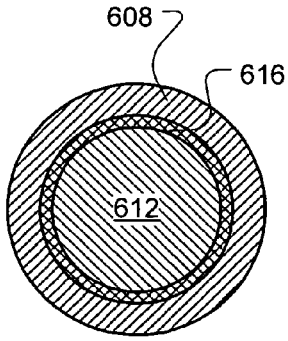
FIG. 6C is a cross-sectional view of the penetrator of FIG. 6A-FIG. 6B taken along the line 6C-6C in FIG. 6B.

Still referring to FIG. 6A, the forebody 602 further includes a pin 612 extending aftward from the body portion 606. When assembled, the pin 612 is received in a blind bore 614 defined by the stabilizing portion 608 to couple the forebody 602 and the stabilizing portion 608, as shown in FIG. 6B. FIG. 6C is a cross-sectional view taken along the 6C-6C line in FIG. 6B to illustrate an embodiment wherein the pin 612 is adhesively bonded within the bore 614 by an adhesive layer 616. In various embodiments, the adhesive layer 616 may comprise epoxy, silicone, cyanoacrylate, polyurethane, or the like. Alternatively, the pin 612 may have a press-fit relationship with the bore 614 and, in such an embodiment, the adhesive layer 616 is omitted. The scope of the present invention, however, encompasses any means for coupling the forebody 602 and the stabilizing portion 608, including pins (such as the pin 612) and bores (such as the bore 614) of various sizes and shapes.

For example, the pin 612 may be part of the stabilizing portion 608 and the forebody 602 may define the bore 614, in which the pin is received. Alternatively, the pin 612 may be a separate element and each of the forebody 602 and the stabilizing portion 608 may define a bore (e.g., the bore 614) therein. In such an embodiment, the pin 612 would be received in both of the bores. Alternatively, other mechanical elements and/or interconnections may be used to detachably couple the forebody 602 and the stabilizing portion 608, and such mechanical elements and/or interconnections are considered to be within the scope of the present invention.

Further, the penetrator 410 may comprise a portion for aerodynamically stabilizing the penetrator 410 having a configuration that is different from the stabilizing portion 608. The scope of the present invention includes any chosen structure or structures for stabilizing the penetrator 410 and, in some embodiments, at least a portion thereof is adapted to produce a plurality of sparks upon impact with a target. In various embodiments, the stabilizing portion 608 may comprise, at least in part, a pyrophoric material, such as mischmetal, a mischmetal mixture, a mischmetal/iron mixture, zirconium, a zirconium alloy, and/or a depleted uranium alloy.

Figure 7:
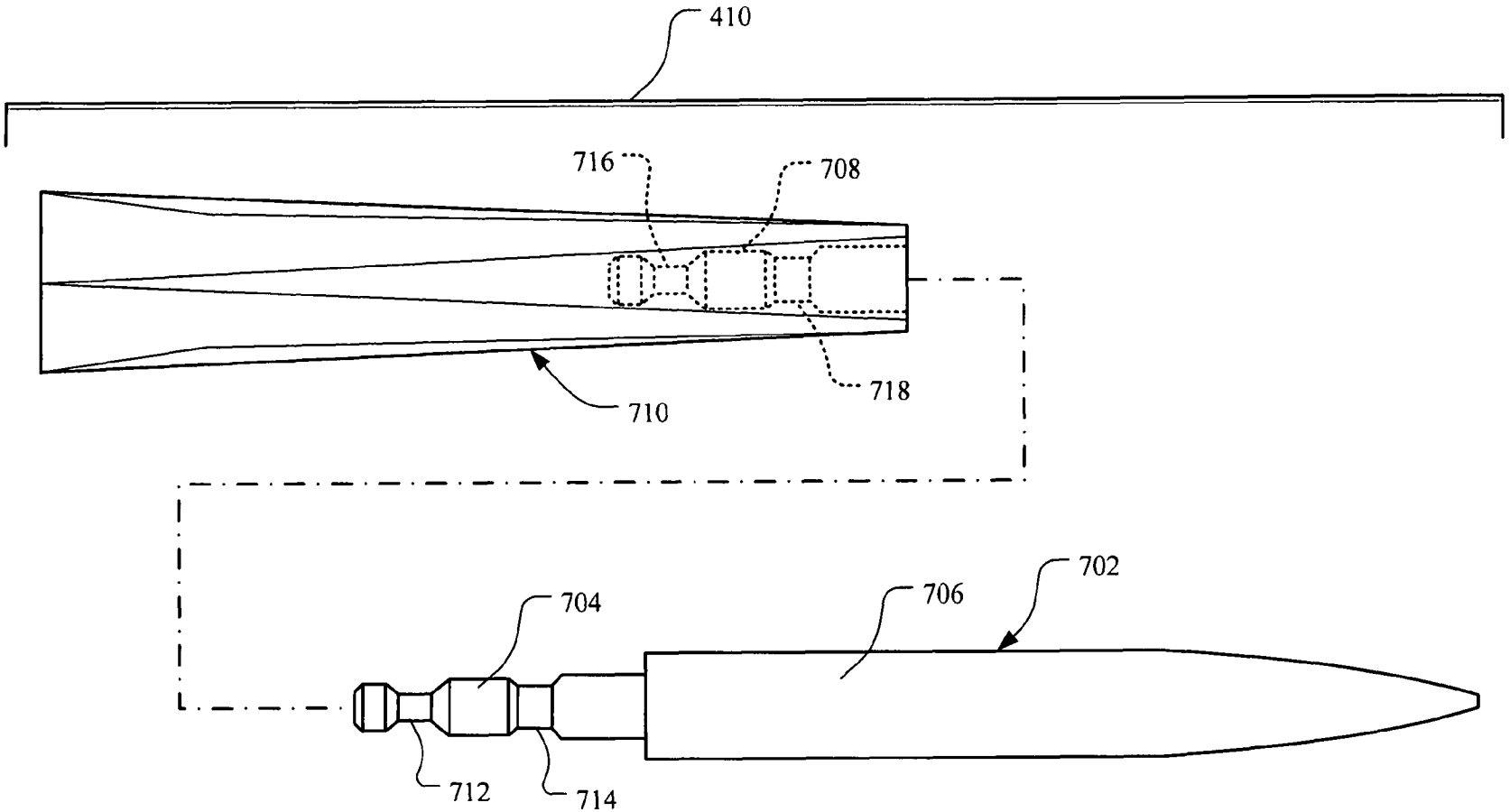
FIG. 7 is an exploded, side view of a third illustrative embodiment of a penetrator of the warhead of FIG. 1A-FIG. 1B according to the present invention.

Alternatively, as shown in FIG. 7, the penetrator 410 may comprise a forebody 702 that includes a pin 704 (as an alternative to the pin 512 of FIG. 5B) extending aftward from a body portion 706. When assembled, the pin 704 is received in a blind bore 708 (as an alternative to the blind bore 614 of FIG. 6A) defined by a stabilizing portion 710. The pin 704 comprises grooves 712, 714 that engage protrusions 716, 718 of the blind bore 708 to detachably couple the forebody 702 with the stabilizing portion 710. In one embodiment, the pin 704 and the blind bore 708 are sized and configured such that the pin 704 may be snapped into and out of the blind bore 708. Thus, by way of example and illustration, each of the pins 512, 704 is but one means for removably attaching the forebody 602, 702 and the stabilizing portion 608, 710. The stabilizing portion 710 (or a portion thereof) may be adapted, in some embodiments, to produce a plurality of sparks upon impact with a target, as discussed above concerning the other penetrator embodiments.

In various embodiments, the forebody 602, 702 may have a center of aerodynamic pressure forward of a center of gravity when separate from the stabilizing portion 608, 710, but the penetrator 410 has a center of gravity forward of a center of aerodynamic pressure when the forebody 602, 702 and the stabilizing portion 608, 710 are mated. In such embodiments, the stabilizing portion 608, 710 may separate from the forebody 602, 702 when penetrating a first target. Because the forebody 602, 702 alone is not aerodynamically stable, it may tumble before reaching a second target or tumble while penetrating the second target.

The penetrators 410 may also have constructions corresponding to any of the penetrators disclosed in commonly owned U.S. patent application Ser. No. 10/251,423 to Hunn et al., published as U.S. Patent Application Publication No. 2004/0055501; commonly owned U.S. Pat. No. 6,843,179 to Hunn et al.; and commonly owned U.S. patent application Ser. No. 10/445,611 to Hunn, each of which is hereby expressly incorporated by reference for all purposes. Note, however, that the configuration of penetrators 410 is not limited to the configurations detailed herein. Rather, the penetrators 410 may include any suitable configuration.

Figure 8:
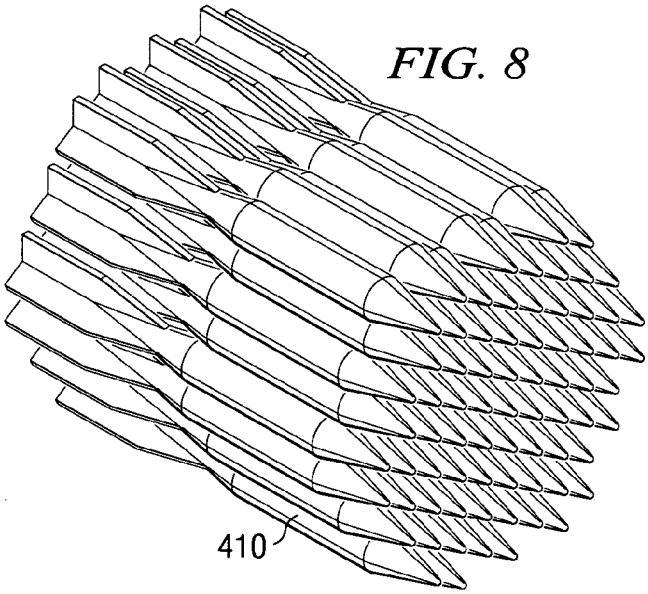
FIG. 8 is a perspective view of a pack of penetrators of the warhead of FIG. 1A-FIG. 1B.
Figure 9:
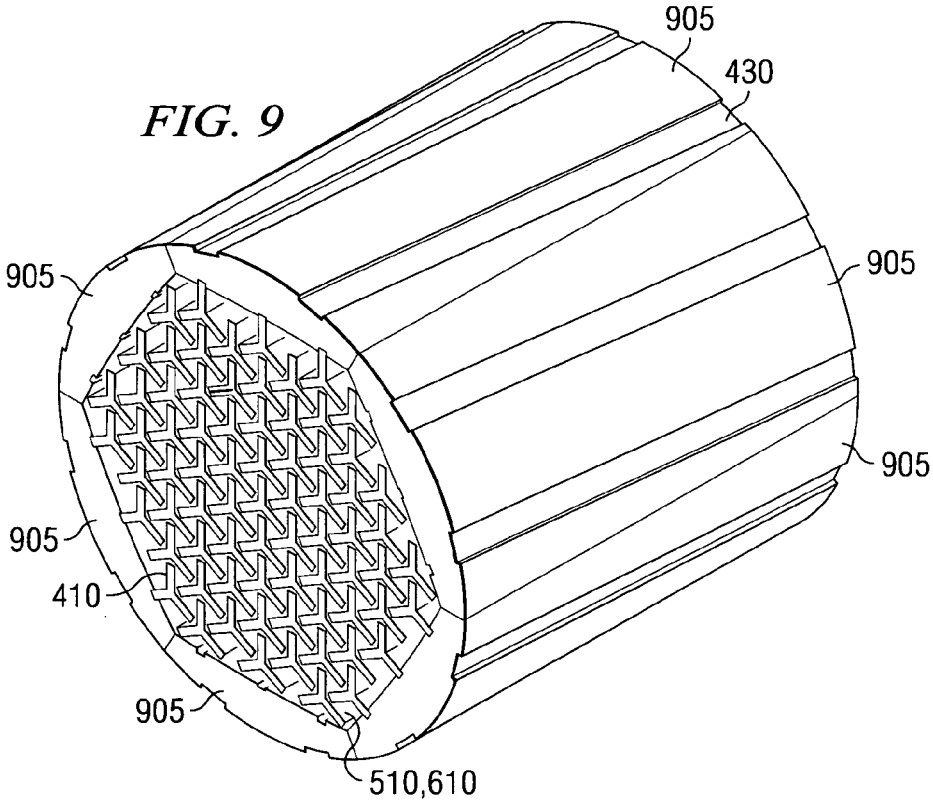
FIG. 9 is a perspective view of the pack of penetrators of FIG. 8 disposed in a segmented sabot.

In one embodiment, illustrated in FIG. 8-FIG. 9, the penetrators 410 are arranged in hexagonal close-packed relationship to maximize the number of penetrators 410 within the sabot 425. Further, the sabot 425 comprises a plurality of segments 905 that, when fitted together, surround the penetrators 410. While the illustrated embodiment incorporates six segments 905, any plural number of segments (e.g., four segments, seven segments, etc.) may be employed.

Referring again to FIG. 1A-FIG. 2 and FIG. 4, the cartridge 405 is ready to be fired when the barrel 105 is extended to a desired fixed or variable position from the housing 110, as described above. Note that the cartridges 405 may be fired simultaneously, individually, or in any desired combination. Referring specifically now to FIG. 4, the expulsive charge 420 provides the motive force to expel or fire the penetrators 410 from the open end 112 of the barrel 105. When the expulsive charge 420 is initiated or activated, e.g. by a firing pin, a detonator, or the like (not shown), gases produced by the activated expulsive charge 420 urge the pusher plate 415 forward, toward the open end of the barrel 105. The pusher plate 415, in turn, urges the penetrators 410 and the sabot 425 through and out of the open end 112 of the barrel 105. The segments 905 of the sabot 425 separate from one another, moving away from the penetrators 410 after they leave the barrel 105, which allows the penetrators 410 to continue toward the target uninhibited by the sabot 425. Note that, in the illustrated embodiment, a forward end 437 of the sabot 425 is "cupped", so that the segments 905 of the sabot 425 are urged apart as the sabot 425 moves through the air after it leaves the barrel 105.

In embodiments wherein the sabot 425 and the barrel 105 comprise rifling grooves 430, 440, respectively, the sabot 425 and the pack of penetrators 410 disposed therein rotate or spin about a longitudinal axis of the sabot 425 as they are urged through the barrel 105. Note that, in the embodiment illustrated in FIG. 9, fins 510, 610 of the penetrator 410 engage the sabot 425 and nest against one another, such that the penetrators 410 are rotated along with the sabot 425 as they move through the barrel 105. Other means for coupling the penetrators 410 and the sabot 425, however, are within the scope of the present invention. The spin rate of the sabot 425 and, thus, the penetrators 410 is directly related to the angle of the rifling grooves 430, 440 with respect to the longitudinal axis of the barrel 105, as is known to the art. Once the sabot 425 and the penetrators 410 leave the barrel 105, the segments 905 of the sabot 425 move away from the penetrators, as discussed above. Because the penetrators 410, as a collective pack, are spinning, centrifugal force (i.e., an inertial force of rotational motion) disperses the penetrators 410 from one another, providing a greater, selective coverage area as will be discussed in greater detail below.

Figure 10:
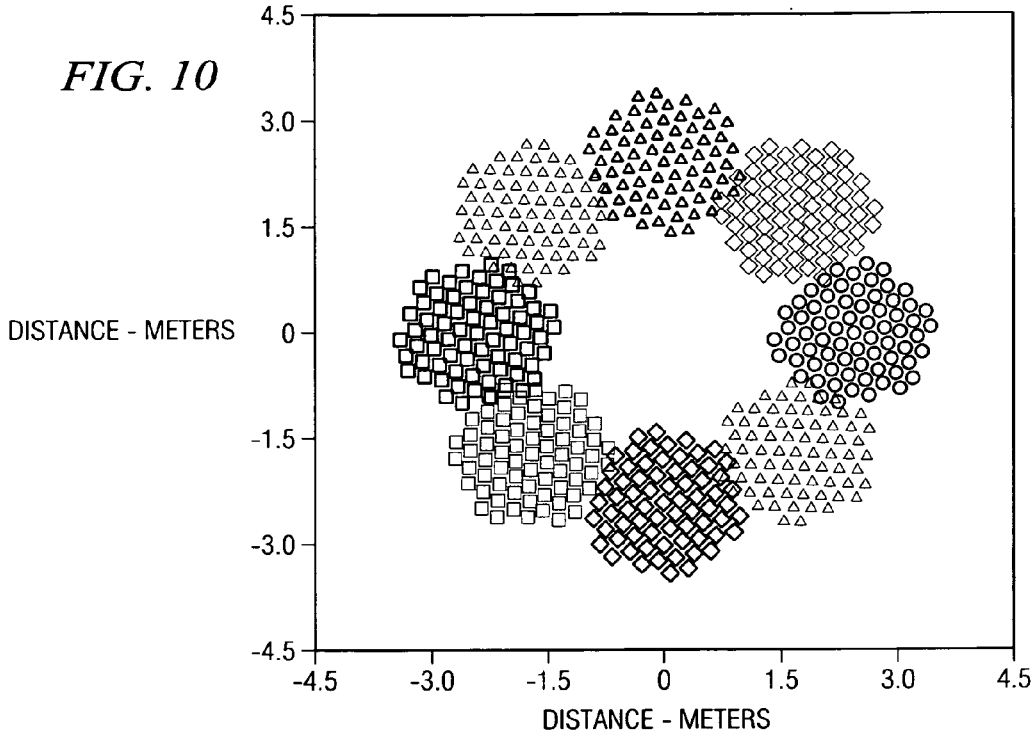
FIG. 10 is a graphical representation of a target plane impacted by penetrators of the warhead of FIG. 1A-FIG. 1B illustrating eight separate penetrator pack dispense patterns.

FIG. 10-FIG. 19 illustrate various aspects of the operation of the warhead 100 according to the present invention. In each of these examples, all eight cartridges 405 are fired simultaneously. FIG. 10 provides an exemplary graphical depiction of a target plane impacted by approximately 584 penetrators 410 with the projectile 200 aimed at the center (i.e., the "0, 0" point) of the grid. In this example, the "barrel dispense angle" (i.e., an angle A defined by a centerline 130 of the projectile 200 at the centerline 135 of the barrel 105, as shown in FIG. 1B) is chosen to illustrate the eight separate penetrator pack dispense patterns. For this simulation, the velocity of the projectile 200 is about Mach 1.2 and the "delta dispense velocity" (i.e., the difference in velocity between the projectile 200 and the penetrators 410 at firing) is about 152 meters/second. Further, the barrel dispense angle is about 10 degrees and the "dispense-to-target range" (i.e., the distance between the projectile 200 and the target at the time of penetrator 410 firing) is about 50 meters. The "dispense spin rate" (i.e., the rate at which the pack of penetrators 410 is spinning when it leaves the barrel 105 resulting from rifling) is about 100 revolutions/second.

Figure 11:
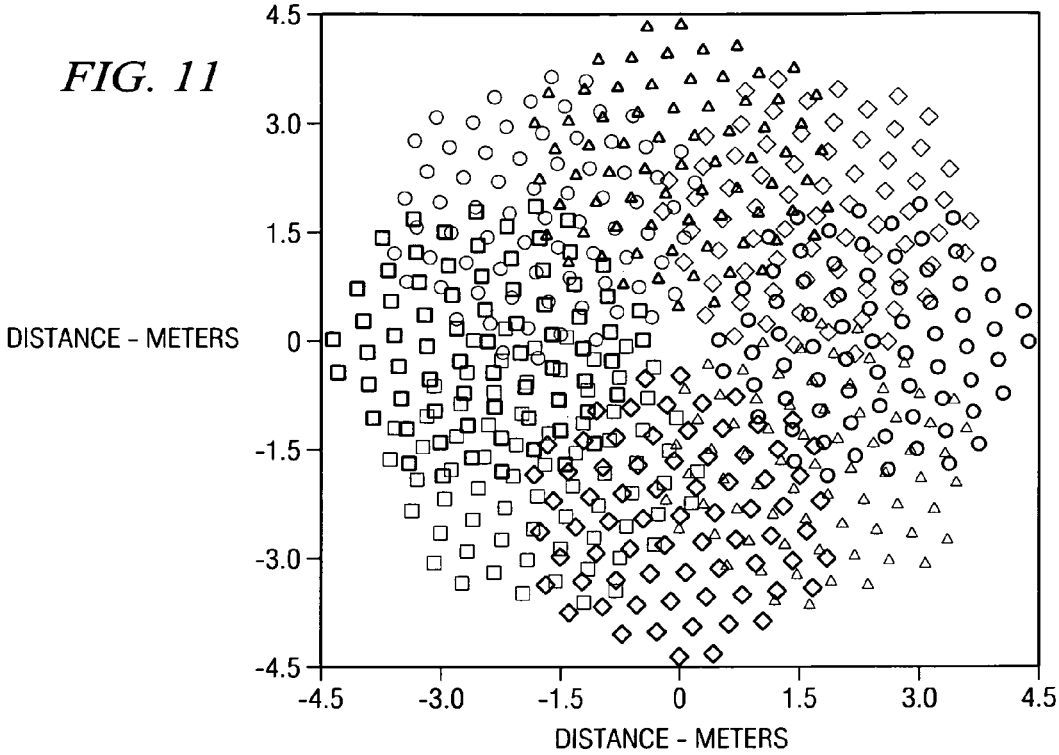
FIG. 11-FIG. 12 are graphical representations of a target plane impacted by penetrators of the warhead of FIG. 1A-FIG. 1B illustrating changes in radii of effect and penetrator pattern density resulting from changes in the penetrators' dispense-to-target range.
Figure 12:
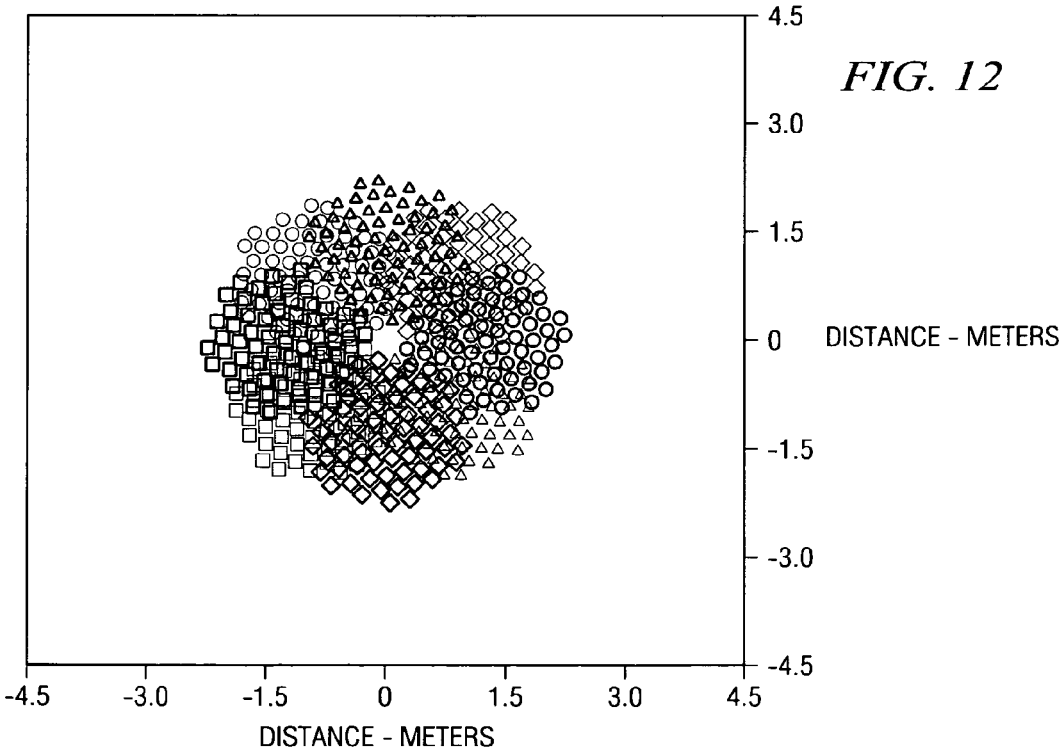

Many different variables can affect the dispense pattern of the penetrators 410. For example, as illustrated in FIG. 11-FIG. 12, the dispense-to-target range can be varied to change the radius of effect and the penetrator pattern density. In each of these examples, the velocity of the projectile 200 is about Mach 1.2 and the delta dispense velocity for about 584 penetrators 410 is about 152 meters/second, producing a dispense spin rate of about 100 revolutions/second. The barrel dispense angle is about five degrees. In the example illustrated in FIG. 11, the dispense-to-target range is about 100 meters, producing a radius of effect of about 4.4 meters and a penetrator pattern density of about 32 penetrators 410 per square meter. Changing the dispense-to-target distance to about 50 meters, as illustrated in FIG. 12, produces a radius of effect of about 2.3 meters with a penetrator pattern density of about 134 penetrators 410 per square meter.

As discussed above, spinning the pack of penetrators 410 creates a centrifugal force that disperses the penetrators 410 and, therefore, decreases the penetrator pattern density over time. Accordingly, the penetrators 410 have more time to disperse when the dispense-to-target range is about 100 meters than when it is about 50 meters, resulting in a greater radius of effect and a decreased penetrator pattern density at about 100 meters. Thus, changes in the dispense-to-target range are proportional to the corresponding changes in the radius of effect and inversely proportional to the corresponding changes in the penetrator pattern density.

Figure 13:
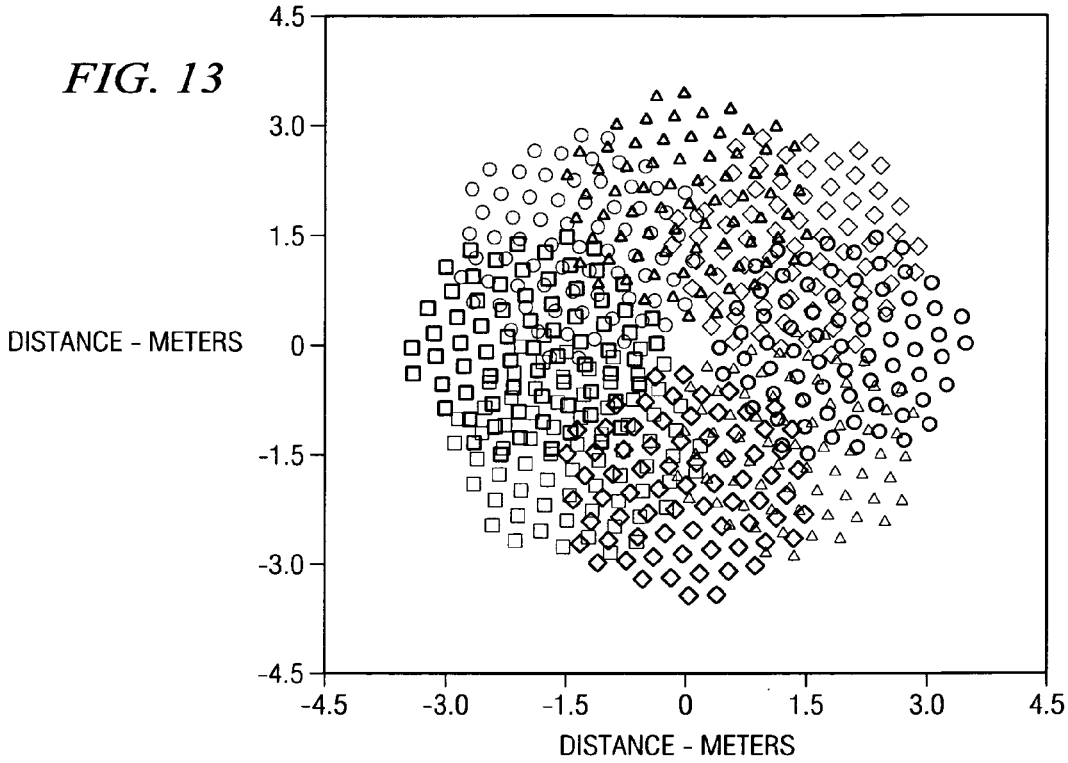
FIG. 13-FIG. 14 are graphical representations of a target plane impacted by penetrators of the warhead of FIG. 1A-FIG. 1B illustrating changes in radii of effect and penetrator pattern density resulting from changes in the penetrators' dispense velocity.
Figure 14:
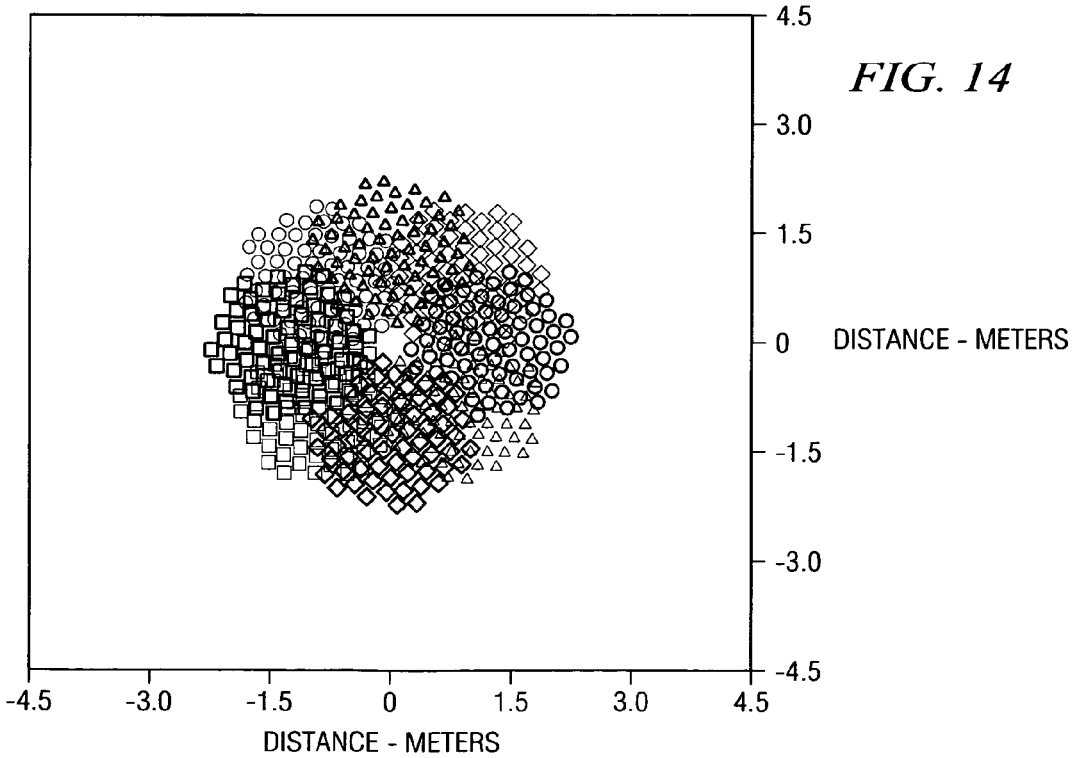

FIG. 13-FIG. 14 illustrate the relationship between the delta dispense velocity and the radius of effect and the penetrator pattern density. In each of these examples, the projectile 200 velocity is about Mach 1.2, the dispense-to-target range is about 50 meters, and the barrel dispense angle is about five degrees. Approximately 584 penetrators 410 are dispensed in each of these examples. In the example illustrated in FIG. 13, the delta dispense velocity is about 305 meters/second, which generates a dispense spin rate of about 200 revolutions/second. The radius of effect is about 3.5 meters and the penetrator pattern density is about 56 penetrators 410 per square meter. By decreasing the dispense delta velocity to about 153 meters/second (producing a dispense spin rate of about 100 revolutions/second), as illustrated in FIG. 14, the radius of effect decreases to about 2.3 meters and the penetrator pattern density increases to about 134 penetrators 410 per square meter. In this example, a lower spin rate creates less centrifugal force and, therefore, less dispersion of the penetrators 410. Accordingly, lowering the dispense delta velocity decreases the spin rate, resulting in smaller radii of effect and greater penetrator pattern densities. Thus, changes in the dispense delta velocity are proportional to the corresponding penetrator pattern density and inversely proportional to the corresponding radius of effect.

Figure 15:
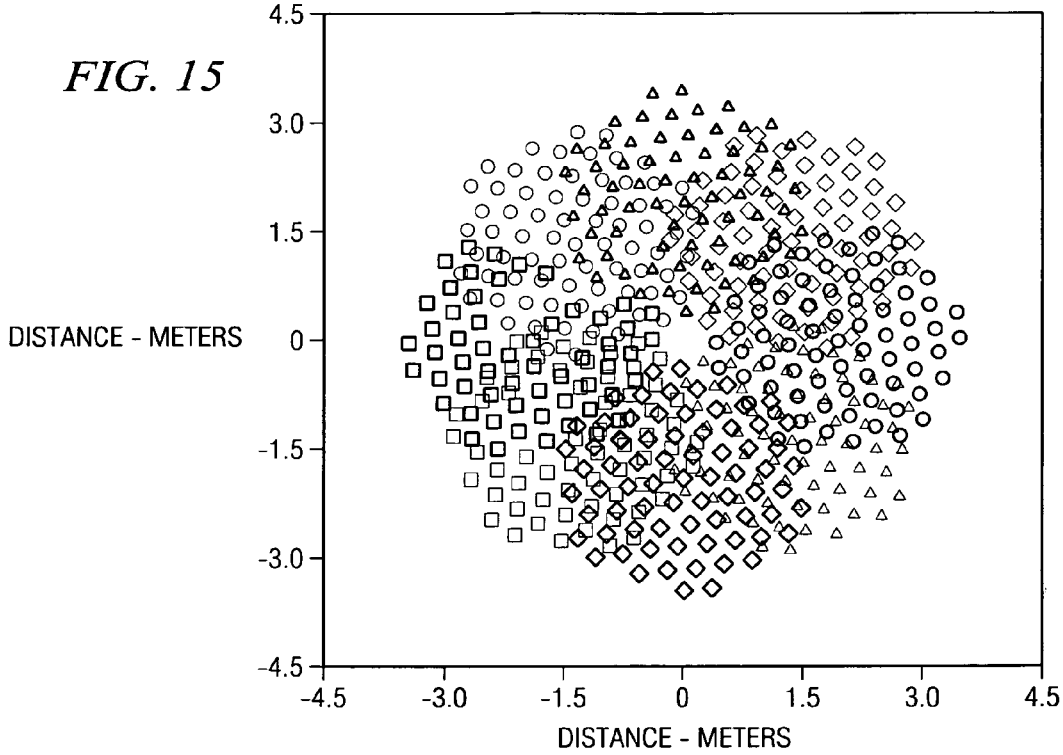
FIG. 15-FIG. 16 are graphical representations of a target plane impacted by the penetrators of the warhead of FIG. 1A-FIG. 1B illustrating changes in radii of effect and penetrator pattern density resulting from changes in the barrel dispense angle.
Figure 16:
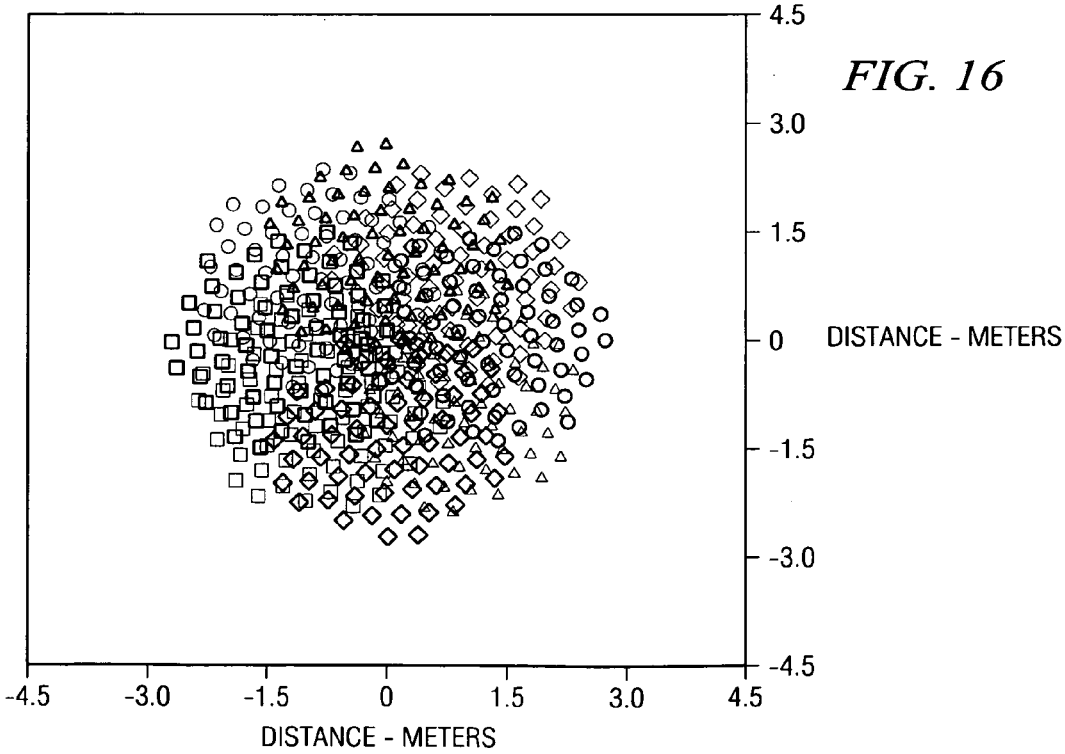
Figure 18:
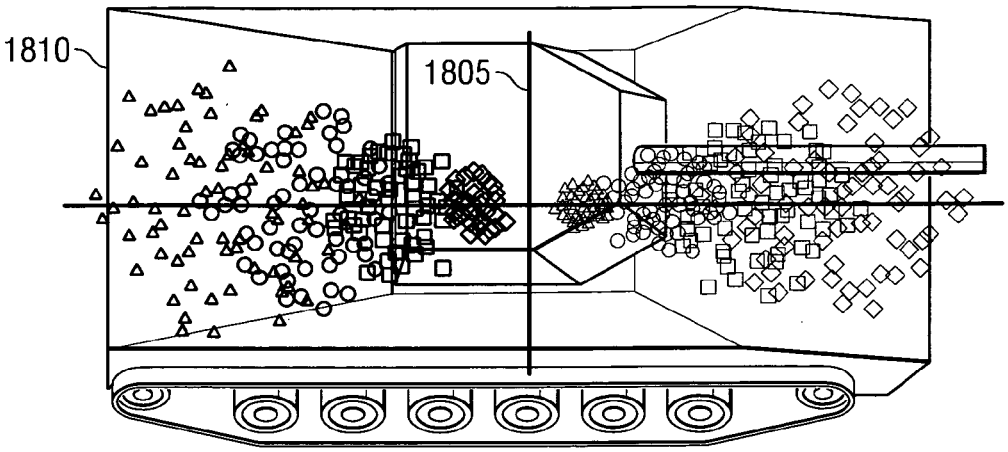
FIG. 18 is a stylized representation of the penetrators of the warhead of FIG. 1A-FIG. 1B operated to impact a target in a desired pattern.

FIG. 15-FIG. 16 illustrate the relationship between the barrel dispense angle and the radius of effect and the penetrator pattern density. In each of these examples, the velocity of the projectile 200 is about Mach 1.2 and the delta dispense velocity for about 584 penetrators 410 is about 305 meters/second, producing a dispense spin rate of about 200 revolutions/second. The dispense-to-target range is about 50 meters. In the example illustrated in FIG. 15, the barrel dispense angle is about five degrees, producing a radius of effect of about 3.5 meters and a penetrator pattern density of about 56 penetrators 410 per square meter. By decreasing the barrel dispense angle to about 3 degrees, as shown in FIG. 16, the radius of effect decreases to about 2.7 meters and the penetrator pattern density increases to about 91 penetrators 410 per square meter. In this example, the penetrator patterns for each of the cartridges 405 overlap more as the barrel dispense angle is decreased. Thus, changes in the barrel dispense angle are proportional to the penetrator pattern density and inversely proportional to the radius of effect. Note that in each of FIG. 11-FIG. 15, the penetrator 410 pattern defines a central area not impacted by the penetrators 410 that can, however, be impacted by the projectile 200. In FIG. 16, however, the central area is purposefully eliminated by decreasing the barrel dispense angle.

Figure 17:
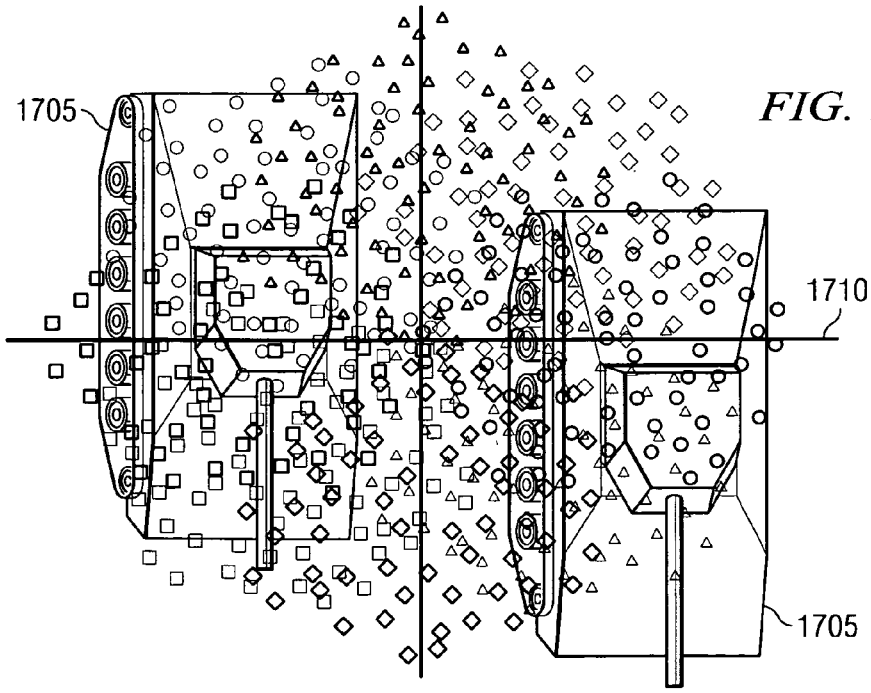
FIG. 17 is a stylized representation of the penetrators of the warhead of FIG. 1A-FIG. 1B operated to cover an area that includes multiple targets.

The principles of operation discussed above can be readily applied to battlefield scenarios to defeat various targets. For example, FIG. 17 illustrates in a bird's-eye view a pair of tanks 1705 traveling generally side-by-side. If a conventional kinetic energy or explosive warhead projectile were used to impact one of the tanks 1705, it is at least possible that the other tank 1705 would remain viable. If such a conventional projectile were aimed between the tanks 1705 (e.g., at the center of the crosshair 1710), the tanks 1705 might be disabled, but they still might remain viable. However, if the projectile 200 were aimed between the tanks (i.e., at the center of the crosshair 1710), the penetrators 410 could significantly impact both tanks 1705, as illustrated in FIG. 17. In various scenarios, reconnaissance information can be used to determine the type of target (e.g., the tanks 1705), the distance between multiple targets, and the like. This information can then be used to determine the various parameters of the warhead 100 to provide adequate impact coverage. In the illustrated example, all cartridges 405 are fired simultaneously to provide about 100 penetrator 410 hits per tank 1705.

It may, however, be advantageous in some situations to selectively fire the cartridges 405 (shown in FIG. 4), rather than firing them all simultaneously. In the example illustrated in FIG. 18, the projectile 200 is aimed at the center of a crosshair 1805 to impact a relatively slow moving tank 1810. Opposing pairs of the cartridges 405 are fired sequentially as the projectile 200 is rolled between firings (e.g., by actuating the projectile 200's fins), generally distributing the penetrators 410 along the length of the tank 1810. In this example, not only does the projectile 200 impact the tank 1810, but approximately 500 penetrators 410 also impact the tank 1810. Thus, the projectile 200 and its warhead 100 may be manipulated to produce a desired impact pattern of the penetrators 410.

Figure 19:
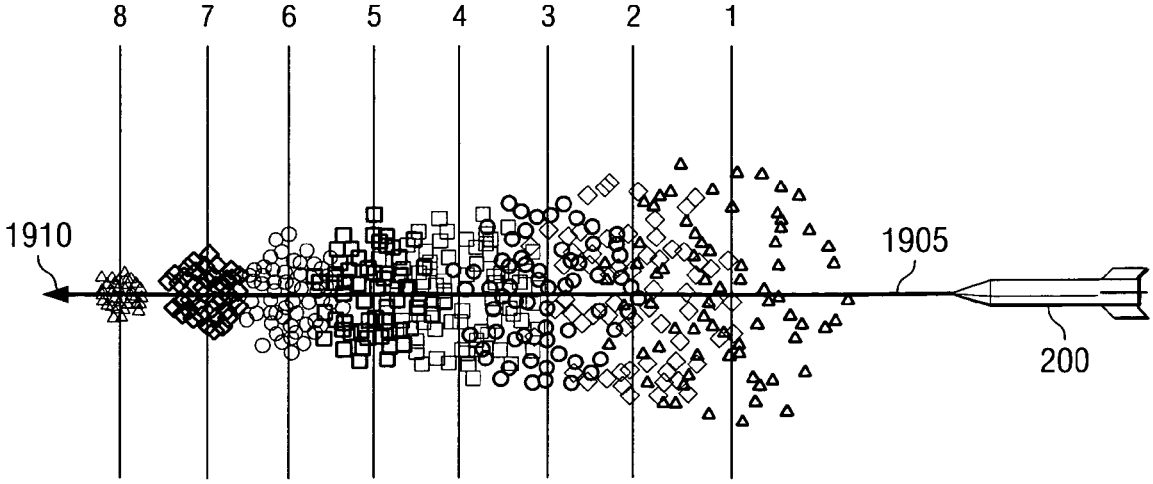
FIG. 19 is a graphical representation of the penetrators of the warhead of FIG. 1A-FIG. 1B operated to impact a target along its trajectory.

For higher velocity targets, it may be desirable to individually fire the cartridges 405 (shown in FIG. 4). For example, higher velocity targets may be difficult to hit with only the projectile 200. In the example illustrated in FIG. 19, the cartridges 405 are individually, sequentially fired such that the penetrators 410 impact along the target's trajectory 1905. The vertical lines intersecting the target's trajectory 1905 in FIG. 19 illustrate the center of impact of each pack of penetrators 410 as they are sequentially fired. For example, the vertical line labeled "1" denotes the center of impact of the penetrators 405 fired from the first cartridge 405, etc. In this illustration, the projectile 200 intercepts the target at about 1910. In one embodiment, the projectile 200 is rolled such that each cartridge 405 being fired is generally in the same roll orientation. Thus, the projectile 200 and its warhead 100 may be manipulated to impact a target multiple times along its trajectory.

While the present invention may employ many different firing scenarios, one exemplary firing scenario includes transferring initial target data from the launch vehicle to a projectile guidance computer, a target detection computer, and a warhead firing computer. Data may include target characteristics and one or more predetermined firing modes for the warhead. Once the projectile is launched, the projectile guidance computer guides the vehicle in the general direction of the target using autonomous or interlinked guidance methods. The projectile guidance computer may utilize global positioning satellite equipment, an inertial navigation system, an inertial measurement unit and/or other positional reference platforms.

Once within targeting range, the projectile guidance computer controls the flight control mechanisms (e.g., fins, jets, or other such control mechanisms) to attempt target intercept. A target detection system is used to detect the target, determine its range from the projectile, and track the target. The target detection system passes data to the guidance computer, where the intercept vector is calculated, including, for example, range, direction, closing velocity, etc.).

The guidance computer controls the flight control mechanisms to improve target intercept probability. Data concerning the range, closing velocity, etc. are also transmitted to the warhead firing computer. The guidance computer and the firing computer decide if the target vector meets any of the predetermined firing protocols. The firing computer may transmit guidance requirements for warhead efficacy to the guidance computer. If the target vector meets a predetermined firing protocol, the firing computer commands the warhead to extend one or more barrels and fire the penetrator or penetrators at the appropriate time. If no predetermined firing protocol is met, the target is again acquired and the intercept vector analyzed with respect to the predetermined firing protocols.

Note that while the projectile guidance computer, the target detection computer, and the warhead firing computer are described as separate elements, the present invention is not so limited. Rather, these elements may be combined into one or more computing devices depending upon the application.

Figure 20:
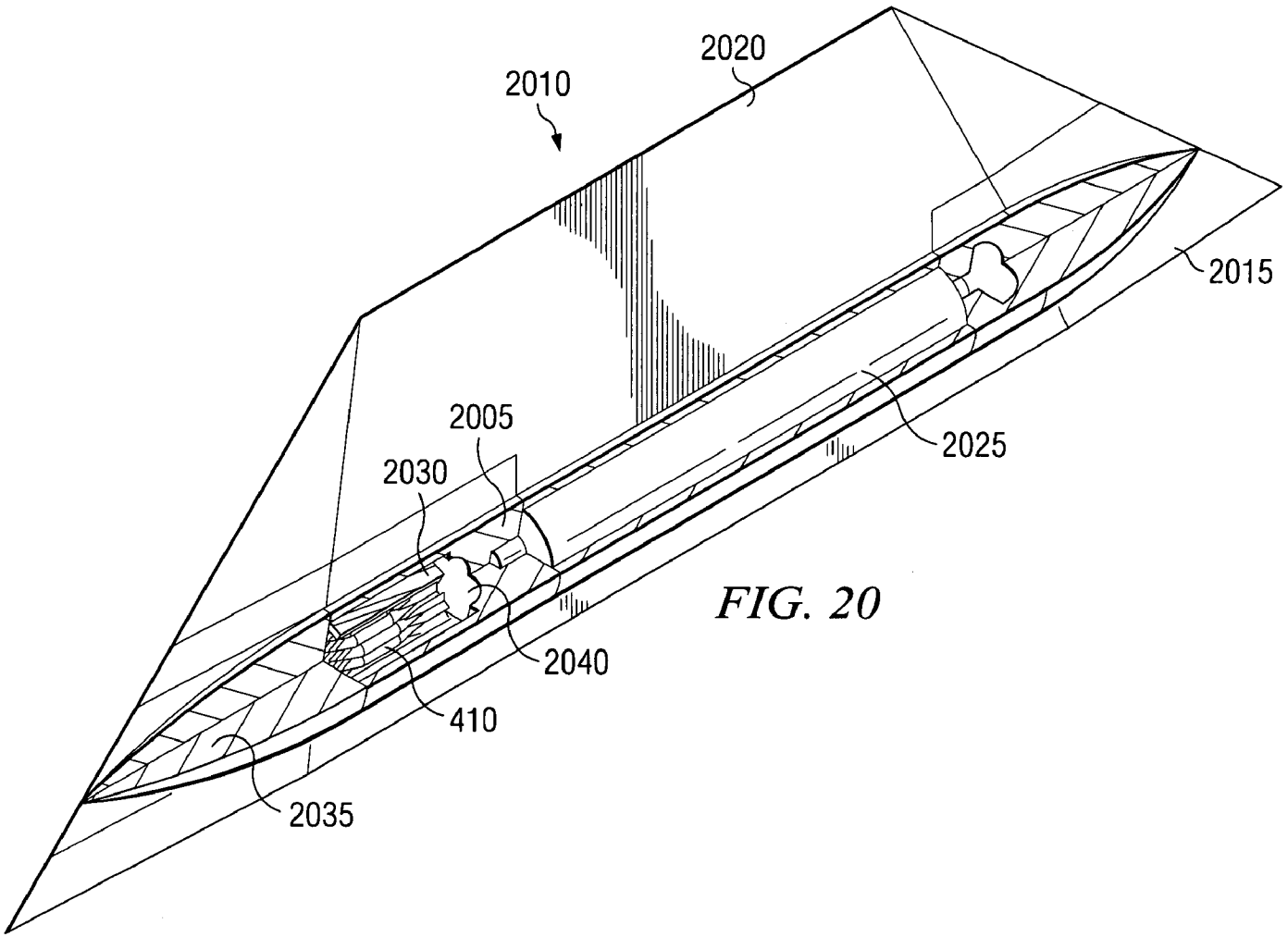
FIG. 20 is a partial cross-sectional, perspective view of an illustrative embodiment of the present invention incorporated into an airfoil.
Figure 21:
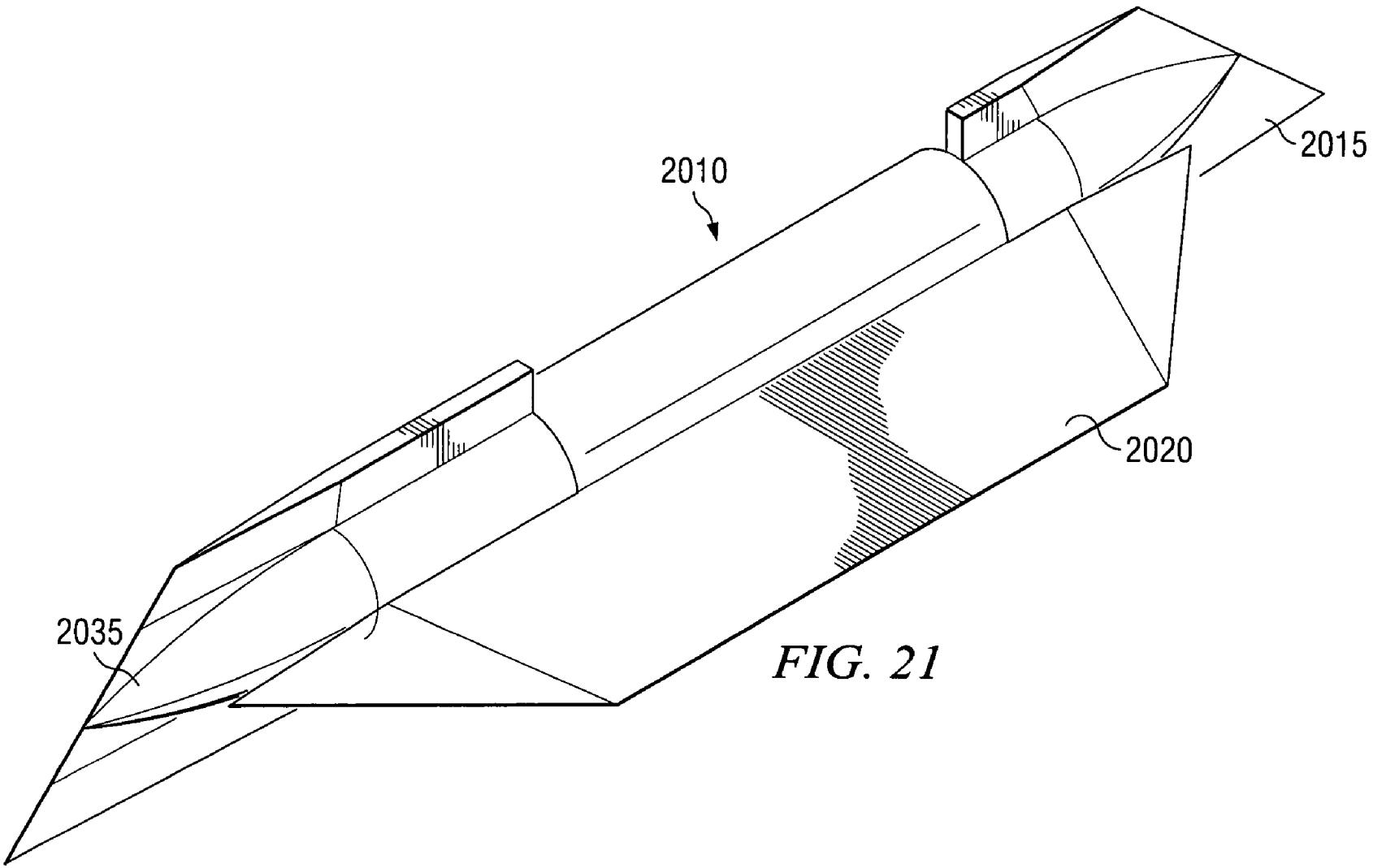
FIG. 21 is a perspective view of the airfoil of FIG. 20 in a folded or stowed configuration.

The present invention may be operatively associated with portions of a projectile other than as illustrated in FIG. 2. For example, as shown in FIG. 20, a barrel 2005, which corresponds to the barrel 105 of FIG. 1, may be incorporated into an airfoil 2010, such as a wing, fin, or the like. In one embodiment, the barrel 2005 is incorporated into the fin 205 of the projectile 200 of FIG. 2. In the embodiment illustrated in FIG. 20, the airfoil 2010, includes a fixed portion 2015 attached to or coupled with a body of the projectile and a movable portion 2020 that is adapted to hinge or fold with respect to the fixed portion 2015 via a fold mechanism 2025. FIG. 21 illustrates the airfoil 2010 in its folded or stowed configuration. The barrel 2005 is disposed in the fixed portion 2015, with a sabot 2030 and one or more penetrators 410 are disposed therein. Fixed portion 2015 further comprises a frangible nose cap 2035, through which the sabot 2030 and the one or more penetrators 410 travel when expelled from the barrel 2005 by an expulsion charge 2040. Note that while only one set of sabot 2030 and penetrators 410 are shown in FIG. 20, such embodiments may include a plurality of sets of sabots 2030 and penetrators 410. Moreover, sabot 2030 and/or barrel 2005 may include rifling, as discussed above concerning FIG. 4.

Figure 22:
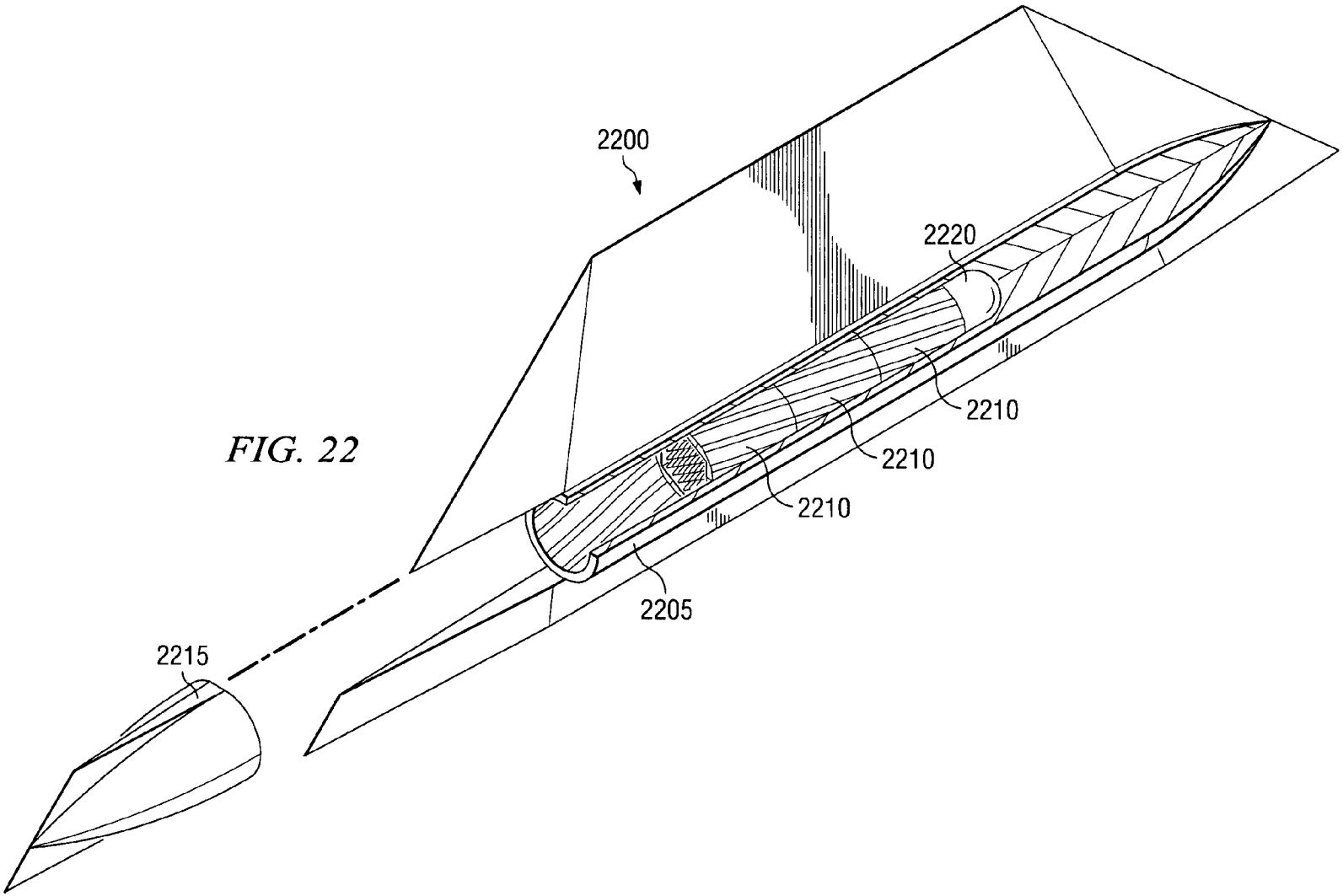
FIG. 22 is a partial cross-sectional, partially exploded, perspective view of an illustrative embodiment of the present invention incorporated into an airfoil alternative to that of FIGS. 20-21.

Alternative to the foldable airfoil 2005 of FIGS. 20-21, FIG. 22 illustrates a fixed airfoil 2200, into which a barrel 2205 has been incorporated. In the illustrated embodiment, airfoil 2200 includes a barrel 2205 in which one or more sabots 2210 are disposed end-to-end. One or more penetrators 405 are disposed in each of the sabots 2210. Airfoil 2205 further includes a removable nose fairing 2215, which is ejected when the sabots 2210 and penetrators 405 are expelled from the barrel 2205 by an expulsion charge 2220. It should be noted that sabot 2210 and/or barrel 2205 may include rifling, as discussed above concerning FIG. 4. Moreover, the removable nose fairing 2215 can be replaced by the frangible nose cap 2035 of FIGS. 20-21 and the frangible nose cap 2035 of FIGS. 20-21 may be replaced by the removable nose fairing 2215 of FIG. 22.

Figure 23:
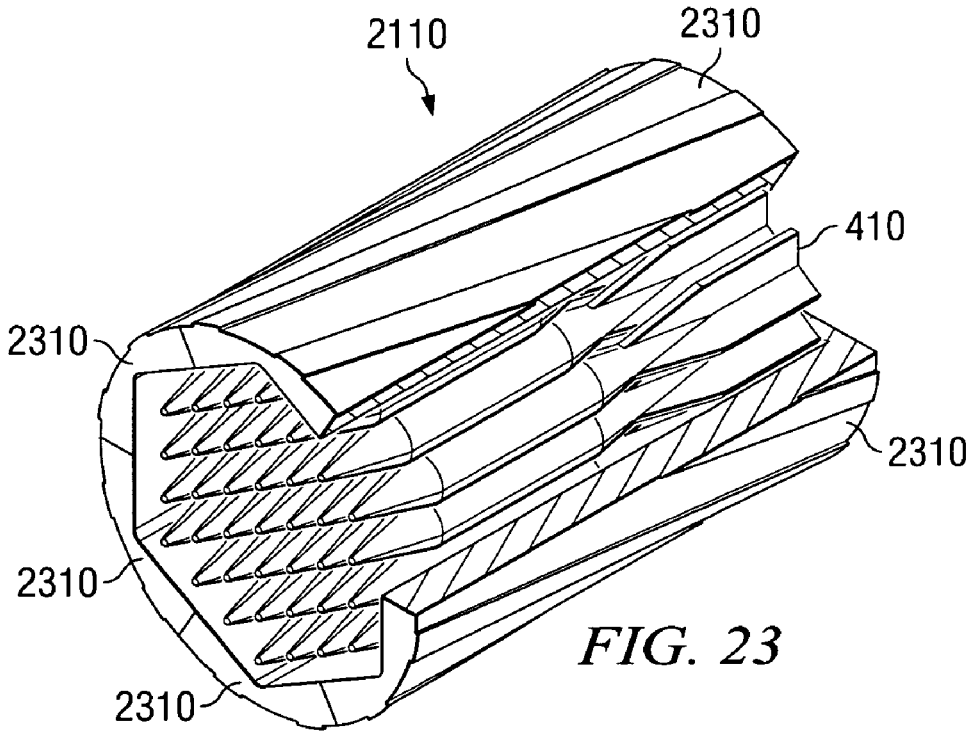
FIG. 23 is a perspective view of an illustrative embodiment of a sabot and plurality of penetrators according to the present invention, in which one segment of the sabot has been removed to more clearly depict the present invention.

FIG. 23 illustrates sabot 2210 in greater detail. In the illustrated embodiment, sabot 2210 comprises six segments 2310; however, sabot 2210 may comprise any suitable number of segments. One of the segments 2310 has been removed in FIG. 23 to more clearly depict the present invention. Alternative to sabot 425 of FIG. 4, sabot 2210 omits the cupped forward end 435. Note that the embodiments of FIGS. 20-22 may include one or more sabots having a configuration corresponding to that of FIG. 23 or the embodiments may include sabots having other configurations, such as sabot 425 of FIG. 4.

Figure 24:
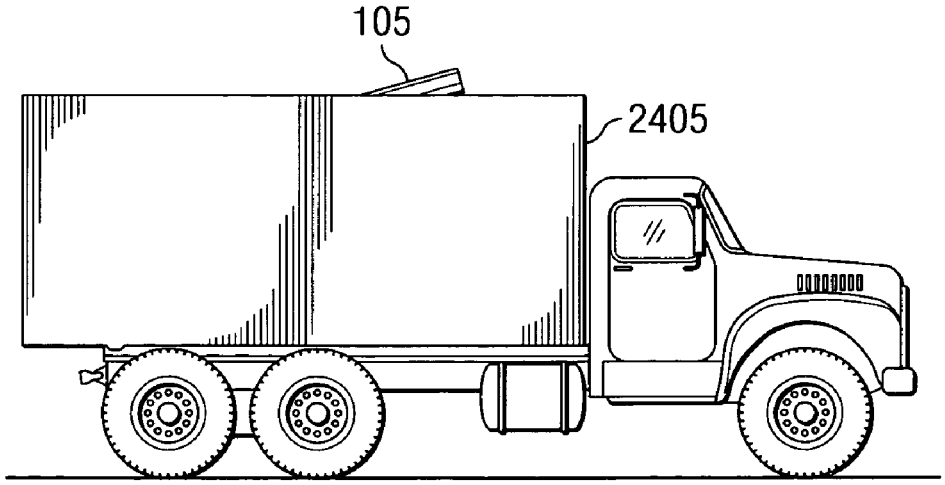
FIG. 24 is a side, elevational, stylized view of a vehicle incorporating the present invention.

While the present invention has been described above in relation to a projectile, it is not so limited. Rather, the warhead of the present invention may be used with any suitable equipment, either stationary or mobile. For example, as shown in FIG. 24, barrel 105 is operatively associated with a ground-traveling vehicle 2405 and is adapted to fire one or more penetrators, such as penetrators 405, therefrom.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A warhead for a vehicle, comprising:

an actuator operatively associated with the vehicle;

a barrel operatively associated with the actuator, the barrel being extendable from and retractable into the vehicle by the actuator;

at least one penetrator disposed in the barrel; and means for expelling the penetrator from the barrel.

2. A warhead, according to claim 1, wherein the barrel is angularly or translationally extendable from the vehicle.

3. A warhead, according to claim 1, wherein the means for expelling comprises:

one of a pressurized gas cartridge, a gas generator, and an explosive charge.

4. A warhead, according to claim 1, further comprising a sabot, such that the at least one penetrator is disposed within the sabot.

5. A warhead, according to claim 4, wherein the sabot includes a plurality of segments.

6. A warhead, according to claim 4, wherein the sabot includes a forward cupped face.

7. A warhead, according to claim 4, wherein the sabot defines a plurality of rifling grooves on an outer surface thereof.

8. A warhead, according to claim 1, wherein the barrel defines a plurality of rifling grooves on an inner surface thereof.

9. A warhead, according to claim 1, wherein the barrel is extendable to at least one firing position.

10. A warhead, according to claim 9, wherein the at least one firing position is includes at least one predetermined firing position.

11. A warhead, according to claim 1, further comprising:

a plurality of penetrators disposed in the barrel.

12. A warhead, according to claim 1, further comprising:

a plurality of barrels operatively associated with the vehicle.

13. A warhead, according to claim 12, wherein the plurality of barrels are circumferentially disposed about the vehicle.

* * * * *